US005282375A

United States Patent [19]

Lee, Jr. et al.

[11] Patent Number: 5,282,375

[45] Date of Patent: Feb. 1, 1994

[54] SPIN FLOW NECKING APPARATUS AND METHOD OF HANDLING CANS THEREIN

[75] Inventors: Harry W. Lee, Jr.; Charles T. Payne, Jr.; Field I. Robertson; Robert K. Thai, all of Chesterfield County, Va.

[73] Assignee: Reynolds Metals Company, Richmond, Va.

[21] Appl. No.: 929,932

[22] Filed: Aug. 14, 1992

Related U.S. Application Data

[63] Continuation-in-part of Ser. No. 884,810, May 15, 1992, abandoned.

[51] Int. Cl.[5] ..... B21D 19/12

[52] U.S. Cl. ..... 72/4; 72/94

[58] Field of Search ..... 72/3, 4, 84, 94, 420

[56] References Cited

U.S. PATENT DOCUMENTS

| | | | |
|---|---|---|---|
| 1,356,980 | 10/1920 | Gray . | |
| 3,227,070 | 1/1966 | Brigham et al. . | |
| 3,266,451 | 8/1966 | Kraus . | |
| 3,283,551 | 11/1966 | Kraft et al. . | |
| 3,469,428 | 9/1969 | Aschberger . | |
| 3,613,571 | 10/1971 | Russell et al. . | |
| 3,688,538 | 9/1972 | Hoyne . | |
| 3,754,424 | 8/1973 | Costanzo . | |
| 3,797,429 | 3/1974 | Wolfe | 72/94 |
| 4,023,250 | 5/1977 | Sproul et al. . | |
| 4,058,998 | 11/1977 | Franek et al. . | |
| 4,070,880 | 1/1978 | Gombas . | |
| 4,140,072 | 2/1979 | Bartling et al. | 72/4 |
| 4,170,888 | 10/1979 | Golata . | |
| 4,341,103 | 7/1982 | Escallon et al. . | |
| 4,391,511 | 7/1983 | Akiyama et al. . | |
| 4,606,207 | 8/1986 | Slade . | |
| 4,838,064 | 6/1989 | Pass . | |
| 4,870,847 | 10/1989 | Kitt . | |

*Primary Examiner*—Lowell A. Larson

*Attorney, Agent, or Firm*—Robert C. Lyne, Jr.; Benjamin J. Hauptman

[57] ABSTRACT

A multi-station machine for necking-in the open end of a metal container body includes a plurality of necking spindle assemblies mounted at circumferentially spaced locations on a tooling disc turret in coaxial alignment with corresponding base pad spindle assemblies mounted to a base pad turret. The turrets are co-rotatable with a main turret shaft. Cam controlled tooling activating assemblies are mounted on the tooling disc turret to control the necking-in movement of an eccentric roll and an external forming roll in each necking spindle in synchronism with the delivery of vacuum suction through the base pad spindles which clamps the container bottom walls to the respective base pads. A sequential latching arrangement associated with the tooling activating assemblies prevents tool-to-tool contact between the outer forming rolls with the eccentric rolls in the absence of container bodies on station. The vacuum manifold arrangement features the supply of high volume, low suction vacuum to a small number of stations in the vicinity of the infeed location to rapidly locate the container bodies on the base pads. A low volume, high suction vacuum supply tothe downstream spindles ensuress proper clamping suction to properly maintain the containers on the base pads during necking. In the absence of contains at various stations, the high volume, low suction vacuum is subject to leakage only at a small number of stations at the infeed while vacuum leakage in the remainder of the stations is insufficient to lower clamping pressure to unacceptable levels.

24 Claims, 28 Drawing Sheets

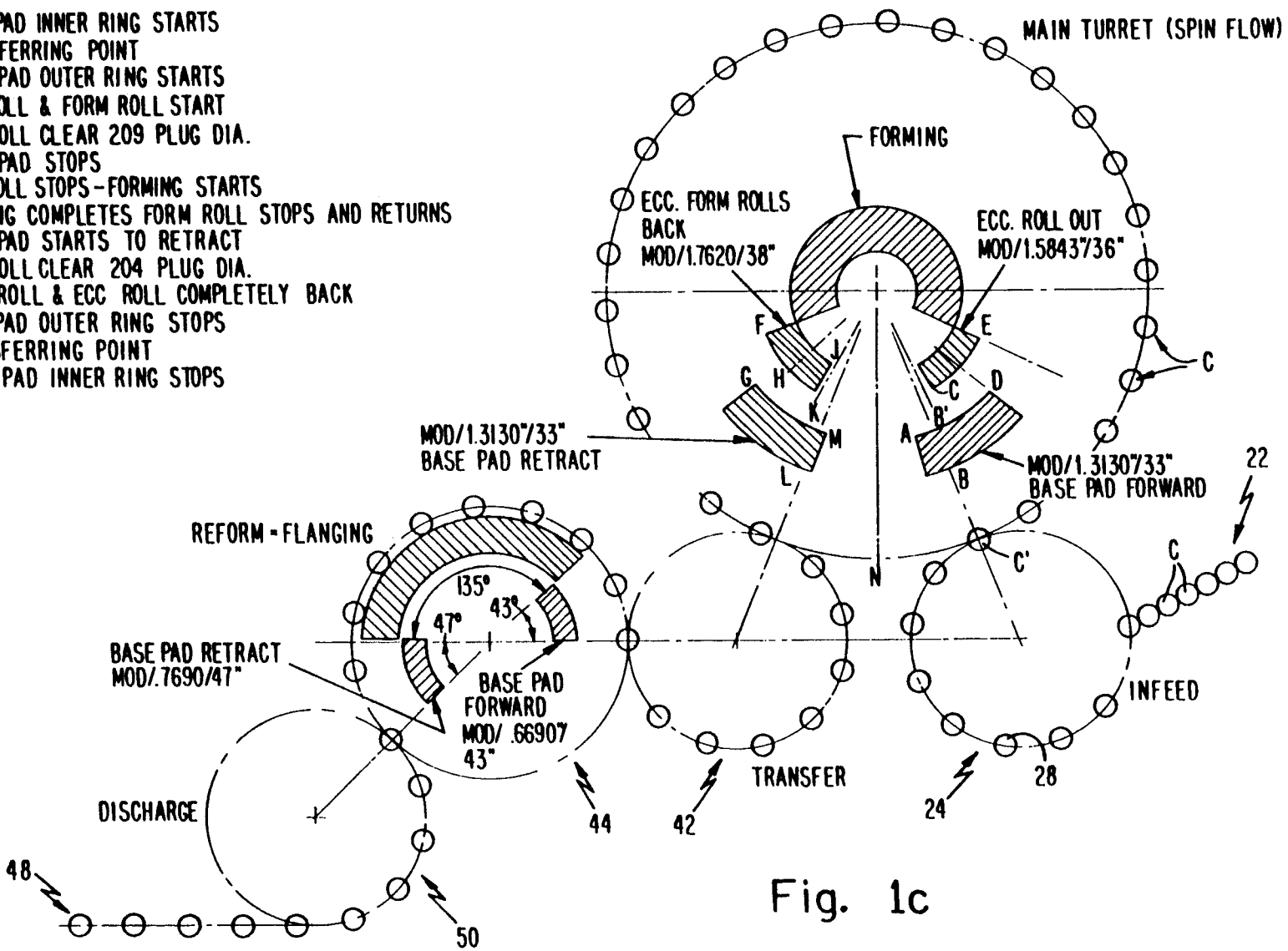

"A" 14.5° BASE PAD INNER RING STARTS
"B" 22° TRANSFERRING POINT
"B'" 24° BASE PAD OUTER RING STARTS
"C" 29.5° ECC ROLL & FORM ROLL START
"C'" 46.5° ECC ROLL CLEAR 209 PLUG DIA.
"D" 47.5° BASE PAD STOPS
"E" 64.5° ECC ROLL STOPS-FORMING STARTS
"F" 290.5° NECKING COMPLETES FORM ROLL STOPS AND RETURNS
"G" 307.5° BASE PAD STARTS TO RETRACT
"H" 314° ECC ROLL CLEAR 204 PLUG DIA.
"J" 329.5° FORM ROLL & ECC ROLL COMPLETELY BACK
"K" 330.5° BASE PAD OUTER RING STOPS
"L" 333° TRANSFERRING POINT
"M" 341° BASE PAD INNER RING STOPS

Fig. 1c

A
18
32
INNER RING STARTS
VACUUM ON

B
36
34
39'
39
26
TRANSFERRING

B'
39'
C
OUTER RING STARTS

C
88
C
ECC. FORM ROLLS START

D
38
BASE PAD STOPS

E
40
88
ECC. ROLL STOPS
FORMING STARTS

SPIN FLOW NECKING APPARATUS AND METHOD OF HANDLING CANS THEREIN

RELATED APPLICATION

This application is a continuation-in-part of co-pending application Ser. No. 07/884,810, filed May 15, 1992, entitled "Spin Flow Necking Apparatus and Method of Handling Containers Therein", now abandoned.

TECHNICAL FIELD

The present invention relates generally to manufacturing containers or cans for beverages such as soft drinks, beer, and juices, and, more particularly, to a multiple-station machine for spin flow necking of the open end of can bodies.

BACKGROUND ART

Metal can bodies are frequently formed with a cylindrical side wall projecting from an integral bottom wall, by a drawing and ironing (D&I) process, as is well known. Beverage cans have a nominal diameter of, for example, two and eleven sixteenths inches (a "211" can). The open end is necked and flanged to, for example, a neck diameter of "206" (two and six sixteenths inches) on the standard 211 can or even to a "204" neck (two and four sixteenths). After the can is filled with a beverage, a can end or lid is sealed onto it by double-seaming.

The purpose of necking the can is to allow the use of a smaller diameter end. The neck enables the flange, and therefore the can end, to be of smaller diameter than if there were no neck, which means further metal reduction and thereby cost savings in metal. Necking also minimizes the radial extent of the flange which is formed at the end of the necked portion and thus helps to resist flange cracking. The neck may also provide a convenient way for a carrier to engage a plurality of cans.

There are various ways of necking a beverage can. One known method involves the use of static necking dies wherein the can is conveyed through a number of stations. At each station, a die ring is relatively reciprocated into contact with the open end while the can bottom is non-rotatably held with a base pad assembly. At each successive station, the static necking die is of progressively smaller diameter to progressively neck the can to the desired diameter.

Other necking methods involve rolling or spinning the neck and/or flange, using an external spinning roll cooperating with an internal member within the can body. In these methods, the can body is supported rigidly by an internal mandrel or the like. The internal member may be a spinning roll, pilot, or mandrel supporting the can body. In one such method, the neck and flange are formed simultaneously in a can body supported internally and rigidly by a mandrel or chuck of an expanding/collapsing type, the neck and flange profile being formed by external spinning rolls cooperating with this mandrel.

In another such method, the can body is supported internally by an anvil and endwise by a spinning pilot; the neck and flange are formed by a profiled, external spinning roll which deforms the can body into a groove on the pilot and anvil, and the roll is moved axially of the can body.

The problems associated with the rolling or spin forming of the neck as used in the prior art identified hereinabove concern the weak and relatively unsupported upper side wall metal of the open end of the can body. Such metal is usually very thin (e.g., about 0.004—0.006 inches), highly worked during ironing and highly grain oriented. Merely placing a tool with the desired profile inside the can and applying a similarly shaped roller to the outside of the can while it is spinning does not give the metal adequate or complete support to prevent wrinkling, cracking, buckling, crushing or tearing during the forming operation. This uncontrolled or unsupported application of radial side force on the thin metal side wall of the open end is unacceptable in connection with operations performed at multiple stations wherein the rate of production of the cans during necking may be as high as 1,500–2,000 cans per minute.

A spin flow necking process and apparatus are disclosed in U.S. Pat. No. 4,781,047, issued Nov. 1, 1988 to Bressan et al, which is assigned to Ball Corporation and is exclusively licensed to the assignee of the present application, Reynolds Metals Company. The disclosure of this patent is hereby incorporated by reference herein in its entirety. It concerns a process where an external free roll is moved inward and axially against the outside wall of the open end of a rotating trimmed can to form a conical neck at the open end thereof. A spring loaded holder supports the interior wall of the can and moves axially under the forming force of the free roll. This is a single operation where the can rotates and the free roll rotates so that a smooth conical necked end is produced. In practice the can is then flanged.

The term "spin flow necking" is used in this application to refer to such processes and apparatus, the essential difference between spin flow necking and other types of spin necking being the axial movement of both the external roll and the internal support.

Spin flow necking as described above offers the potential of making a 204, 202, 200, or even smaller neck on a standard 211 can, in a single multiple-station machine. Spin flow necking also offers can wall thickness reductions because of the lower necking load requirements imposed on the can during necking. Spin flow necking also has the potential for minimizing flange width variations, and the resulting can has a smooth profile and an attractive appearance. However, to make spin flow necking truly effective as a viable production process, it is necessary to incorporate a large number of spin flow necking stations in a machine having can handling capabilities permitting a throughput of approximately 1,500–2,000 cans per minute. Such a machine must be capable of rapidly and reliably feeding cylindrical can bodies onto the spin flow necking assemblies at a high production speed and must be capable of supporting the can bottom walls both quickly and in true alignment with the spin flow necking tooling. Such a machine must also preferably have the capability of preventing tool-to-tool contact between the surfaces of the spin flow necking tools during periods of disruption in can supply to prevent early wear and replacement of these extensive tools. To our knowledge, there is no previously known method or machine for providing adequate support or complete positive control over the cans during spin flow necking so that these requirements can be met.

It is accordingly one object of the present invention to provide a combination of an external roller and an internal holder which cooperate to overcome the problems of metal damage during a necking operation by means of spin flow necking.

Another object of the invention is to disclose a holder which co-acts with a forming roller to provide continuous support for the metal being spin flow formed into a neck in a machine having multiple spin flow necking stations for necking metal cans at each station down to a desired necked diameter.

Another object is to provide a spin flow necking machine capable of handling a large number of can bodies successively fed to the machine by ensuring that the can bodies are quickly and reliably retained in the machine in true alignment with the spin flow necking tooling and with sufficient clamping force applied to the can end walls to support the can during necking.

Another object is to ensure that the can bodies are easily and rapidly mounted in centering alignment with the spin flow necking tooling.

Still another object is to ensure that spin flow necking occurs at each station with adequate and complete support to the can to prevent wrinkling, cracking, buckling, crushing or tearing of the can side wall.

Still another object is to prevent uncontrolled or unsupported application of radial side force on the can open end by the spin flow forming roller.

Yet another object is to provide a multi-station spin flow necking machine having lower necking load requirements.

Still another object is to provide a multi-station spin flow necking machine which has high production throughput at manufacturing speeds in excess of 1,500 cans per minute.

Another object is to provide a multi-station spin flow necking machine which is capable of rugged and reliable operation in a hostile can making environment of a 24-hour a day aluminum fines atmosphere.

DISCLOSURE OF THE INVENTION

In the present invention, a multi-station spin flow necking apparatus was created for reducing the diameter of an open end of a cylindrical can body, preferably by spin flow necking. The apparatus generally comprises a tooling disc turret and a base pad turret mounted for co-rotation with a main turret shaft. A plurality of necking spindle assemblies are mounted on the tooling disc turret at circumferentially spaced intervals from each other. A plurality of base pad spindle assemblies are mounted on the base pad turret in respective coaxial alignment with the necking spindle assemblies, for respectively engaging a bottom wall of one of the can bodies to be mounted thereto. In a broad sense, each necking spindle assembly includes a first member engageable within the can open end to support the can body on the spindle and a second member mounted adjacent the first member for positioning within the can interior inwardly adjacent the first support member. Means are mounted on the tooling disc turret externally of the can body for radially inward movement into necking contact with the can side wall. Relative movement of the externally mounted means in co-action with the first and second members causes radial inward deformation of, to neck, the can open end. In accordance with a preferred feature of this invention, it is desirable to support the can bottom wall on one of the associated base pad spindle assemblies by supplying suction through the base pad to suck and retain the can bottom wall thereto. Suction supplying means preferably include first means for supplying suction under a first predetermined condition to selected ones of the base pad spindle assemblies and second means for supplying suction under a second, different predetermined condition to others of the base pad assemblies.

More specifically, the first means supplies a high volume flow (e.g., 500 SCFM) of vacuum air under a low or soft vacuum e.g., 7–10" hg (first negative pressure level) to the selected ones of the base pad assemblies adjacent which can bodies to be necked have just been fed to the base pad turret. The high volume flow of vacuum air is sufficient to suck the can bottom wall onto the associated base pad spindle. Thereafter, the second means supplies a low volume flow of vacuum air under a high or hard vacuum, e.g., 20" hg (second negative pressure level), to the other base pad spindles located at rotational positions on the base pad turret downstream from those positions in communication with the first means. The low volume flow and high vacuum are sufficient to hold the can bodies to their base pads while necking forces are applied to the can open end.

In the preferred embodiment, the high volume flow may be provided through a vacuum manifold with a blower vacuum which enables the can bodies just fed to the machine to be rapidly sucked onto the base pad spindles rotating through the infeed region of the turrets. After sucking the can bottoms to the base pads in the aforesaid manner, a lower volume flow of vacuum air can be supplied to maintain the can bottoms to the base pads under greater suction (i.e., a higher vacuum) sufficient to reliably hold the can to the base pad while necking forces are applied to the can open end.

In accordance with a unique feature of this invention, high volume, blower vacuum air is supplied to only a limited number of the base pads (e.g., one or two stations) at any given time, which serves to minimize the loss of vacuum when can bodies are initially being fed to the apparatus, or as the last can bodies are being necked, either event occurring at a time when there are empty stations through which vacuum is being lost. Thereby, by providing the low volume flow of high vacuum air such as through control orifices in a vacuum distribution manifold, the resulting vacuum pressure drop occurring at the empty stations is insufficient to cause dislodgement of can bodies being necked at other stations.

Soft vacuum at high volume flow is preferably in the range of 5–7 inches of mercury and the high vacuum is preferably in the range of 17–20 inches of mercury. The low volume flow of vacuum air at the second pressure level may be supplied through a conventional plant vacuum system. Typically, a minimum suction of about 12–13 inches of mercury must be applied by the base pads to the can bottoms to adequately resist necking forces.

The vacuum distribution system used in the multi-station spin flow necking machine is unique in that it allows for the sequential loading and unloading of the turrets with can bodies without requiring complex valving arrangements and electronic controls for distributing vacuum to the base pad assemblies, with minimal loss of cans during start-up and shut-down when the machine is only partially filled with can bodies. To this end, the suction supplying means includes a wear plate which is mounted for co-rotation with the base pad turret. The wear plate includes pairs of radially adjacent, different diameter first and second ports formed at circumferentially spaced intervals on the plate. A vacuum distribution manifold is mounted stationarily adjacent and in sliding contact with one side of the wear plate. The manifold includes at least one circumferentially extending first slot located at the same first radius as the first port(s) to communicate with an inlet side thereof. At least one circumferentially extending second slot is located at the same second radius as the second port(s) to communicate with an inlet side thereof. The second slot is located downstream from the first slot. The high volume, low vacuum air is supplied to the first slot and the lower volume, high vacuum air is supplied to the second slot preferably from different vacuum sources. Means, co-rotatable with the wear plate and adapted for communication with the outlet side of each first and second port, transmits suction to the base pads.

When the base pads rotate around the turret axis into a position for initially receiving un-necked can bodies, the pads are in communication with the first slot through the first ports which are the large diameter openings in the wear plate in communication at this time with the high volume suction air. As these spindle assemblies rotate about the turret axes, they remain in communication with the high volume air until the can bodies are sucked to the base pad. Thereafter, continued rotation of these assemblies causes the large diameter openings to rotate out of alignment with the first slot. The small diameter openings or control orifices now rotate into alignment with the second slot(s) for communication with the low volume, high vacuum pressure source. This coincides with cam control movement of the necking members on the necking spindle assemblies and the radial inward movement of the external necking means mounted on the tooling disc turret into necking contact with the can side wall. The high vacuum is supplied through the foregoing manifold arrangement throughout necking to securely hold the can body to the base pad with a force sufficient to resist necking forces.

After necking is completed, sequential rotation of the base pad spindles towards the necked can discharge point cause large diameter openings in the wear plate to communicate with atmosphere through the manifold distribution plate to release the vacuum and enable rapid discharge of the necked cans from the machine.

In accordance with another preferred feature of this invention which may be used in conjunction with the foregoing vacuum distribution techniques for optimal results but which is also capable of use with other vacuum supply methods and structures, each base pad spindle is formed with two movable components at the working end thereof. The first component is a central plug formed concentrically within a mounting ring having an annular front surface adapted to contact the periphery of the can bottom wall. Initially, the plug is movable to extend forwardly from the annular front surface to enter an upwardly domed cavity formed in the profiled can bottom wall inwardly adjacent the periphery. The plug features a seal (e.g., an O-ring seal engaging the surface of the domed cavity or a face seal engaging the surface of the can bottom outwardly thereof) about its front periphery so that vacuum supplied from the foregoing vacuum distribution arrangement sucks the can bottom wall into supporting contact with the plug and mounting ring.

Continued forward extension of the movable components directs the open end of the can into supporting engagement with a coaxially aligned holder roll formed in the associated necking spindle assembly on the tooling disc turret. This advantageously both centers and supports the can on the associated necking and base pad spindle assemblies.

The movable components of the base pad are supported in the spindle assembly through a base pad support shaft slidably mounted for keyed co-rotation with a base pad spindle shaft. The base pad support shaft projects rearwardly from the spindle assembly for vacuum line connection and co-rotation with the wear plate. The base pad support shaft is also movable forwardly and rearwardly under the action of cam controlled connecting rod units located rearwardly of the base pad turret to control the timed movement of the plug and mounting ring in their extension and retraction strokes.

The base pad spindle gears of adjacent base pad spindle assemblies are respectively rotated with a pair of idler gears each in meshing contact with a line shaft gear mounted within the base pad turret. This line shaft gear projects rearwardly from the base pad turret to support a driven gear in meshing contact with a large diameter bull gear which is counter-rotated with a separate drive means relative to the direction of co-rotation of the tooling disc and base pad turrets. Each line shaft extends across the space between the turrets and through the tooling disc turret where another line shaft gear is mounted on the line shaft in meshing contact with a pair of idler gears respectively transmitting rotation to a pair of necking spindle gears mounted within adjacent necking spindle assemblies on the tooling disc turret. In this manner, the line shafts synchronously rotate the spindle gears in each pair of aligned necking and base pad spindle assemblies to ensure synchronously controlled spinning of the can bodies.

Each necking spindle assembly therefore preferably includes the holding roll which is mounted on a shaft in the necking spindle housing for rotation by the necking spindle gear, as aforesaid. Projecting forwardly from the holding roll is a free-wheeling eccentric roll mounted to an offset forward end of a support shaft extending coaxially within and through the spindle shaft to project rearwardly from the rear face of the tooling disc turret. The holding roll is spring biased for movement away from the axially fixed eccentric roll as an outer forming member, such as a form roll mounted to the inner face of the tooling disc turret, is radially inwardly displaced into contact with the can side wall proximate the plane along which the holding and eccentric rolls contact each other. Therefore, the holding and eccentric rolls have surfaces which support the can open end on the necking spindle assembly and also have forming surfaces cooperating with the outer form roll to support necking of the can open end into a desired shape as the holding roll is displaced rearwardly by the radially inward movement of the outer form roll into necking contact with the can open end.

Each eccentric roll support shaft carries a pinion on its rear end located outwardly adjacent the rear face of the tooling disc turret. The outer form roll is carried on a pivot shaft which also extends through the tooling disc turret parallel and spaced from its associated eccentric roll support shaft.

A stationary cam is mounted adjacent the rear face of the tooling disc turret. Connecting means, including a cam follower, is provided for transmitting camming movement to both the form roll pivot shaft and the eccentric roll actuating pinion to selectively control the movement of the eccentric roll and outer form roll during rotation of the spindle assemblies about the turret axes. It will be appreciated that this cam controlled movement is coordinated with the operation of the base pad spindle assemblies and the supply of vacuum through the vacuum manifold arrangement, both discussed supra.

In accordance with the preferred embodiment, the connecting means includes a first activating plate mounted on the pivot shaft for co-rotation therewith. This first activating plate is directly connected to the cam follower through a connecting rod arrangement which rotates the first activating plate and thereby the pivot shaft through a first predetermined angular interval sufficient to cause the outer form roll to enter into necking contact with the can side wall or into tool-to-tool contact with the holding and eccentric rolls in the absence of a can body on the spindle. A second activating plate mounted on the pivot shaft for co-rotation with, and by, the first activating plate, carries a rack in meshing contact with the pinion to initially rotate the eccentric roll into its necking position in contact with the can open end during initial radially inward movement of the outer form roll towards the can.

A stop means limits the rotational movement of the second activating plate without preventing further rotational movement of the first plate through the remainder of the first predetermined angular interval. Such stop means may be a stop lug attached to the rear face of the tooling disc turret in alignment with a stop projection extending radially outward form the second activating plate.

A spring is preferably used to connect the first and second activating plates together and o allow the cam follower controlled movement of the first plate to be rotationally transmitted to the second plate until the latter contacts the stop means, as aforesaid. Thereafter the spring is resiliently yieldable to allow further rotation of the first activating plate, against spring bias, and thereby the pivot shaft through a final rotational movement of the first predetermined angular interval which enables the outer form roll to contact the can open end or the holding and eccentric rolls.

In the absence of a can, the movement of the outer form roll through its aforesaid final rotational movement will cause undesirable tool-to-tool contact which results in early wear and the need for frequent replacement of the eccentric, holding and outer form rolls (preferably having carbide tool finishes). In accordance with a unique feature of this invention, therefore, means is provided for latching the first activating plate to impede said final rotational movement and thereby prevent tool-to-tool contact. Such latching means preferably includes a latching projection formed on the first activating plate and a latch operatively mounted adjacent the first activating plate for movement between a latched position and an unlatched position. In the latched position, the latching projection on the first activating plate rotates into latching contact with the latch which prevents said final rotational movement. In the unlatched position, the first activating plate is free to rotate through its final rotational movement as a result of unimpeded travel of the latching projection past the latching point.

The latching projection projects radially outward from the first activating plate. The latch is pivotally mounted to the rear face of the tooling disc turret to project radially inward into the path of movement of the latching projection. Pivotal movement of the latch may be controlled with a fluid actuated cylinder connected to the tooling disc turret and having a spring return loaded plunger connected to the latch.

Means is preferably provided for simultaneously actuating the fluid operated cylinders respectively associated with each of the latches to simultaneously move the latches toward the latching position. Each latching projection has a generally radially outwardly extending latching surface and the latch includes a generally radially inwardly extending latch surface. These surfaces are preferably formed with a negative clearance angle when in contact with each other to prevent the latch from pivoting back to the unlatched position, under spring loaded bias of the cylinder when the fluid pressure acting on the cylinder is released, until the first activating plate is moved by the cam follower to positively rotate the latching surface out of contact with the latch surface, whereupon the latch is biased by the spring loaded plunger to return to the unlatched position.

The latching projection may also include a circumferentially extending surface trailing from the radially outer end of the latching surface. The latch is adapted to contact and ride against this circumferentially extending surface when the first activating plate has been rotated past the latching point as a function of its rotational position about the turret axes of rotation. The latch will then drop into latching position as the first activating plate is rotated by the cam follower in the return direction (i.e., opposite the direction of its final rotational movement) as the latch clears the circumferentially extending surface. In this manner, the latching mechanism of this invention advantageously operates as a sequential latching arrangement in which the necking stations are sequentially locked one at a time as they travel into final necking position. At that position, the outer form rolls are prevented from respectively contacting the holding rolls while the eccentric roll is free to oscillate. The mechanism also operates as a sequential unlatching mechanism since, upon withdrawal of the latches to an unlatched position by release of spring or air pressure, the latches essentially remain latched to the corresponding latching projection on the first activating plate (as a result of the negative clearance) until the station rotates out of the necking position.

When final rotational movement of the first activating plates are prevented by latching, it is necessary to take up the excess travel of the connecting rod arrangement interconnecting the first activating plate to the associated cam follower. To this end, each connecting rod arrangement is essentially and preferably formed from two rods interconnected together with a spring captivated between spring mounts respectively formed on each rod. The spring is sufficiently stiff to bias the rods away from each other through the mounts and thereby transmit the entire range of motion of the cam follower to the first activating plate through the spring, except upon latching as aforesaid, whereupon the final stages of travel of the cam follower is absorbed by the spring operating as a lost motion member as the connecting rod attached directly to the cam follower is moved relative to the second connecting rod attached to the first activating plate which remains relatively stationary due to the latching action.

A method of spin flow necking an open end of a metal can is also disclosed. In accordance with the invention, the method comprises the steps of feeding a can body between a necking spindle assembly mounted on a first turret and a base pad spindle assembly mounted on a second turret in coaxial alignment with the necking spindle assembly while co-rotating the first and second turrets about their common axes of rotation. A bottom wall of the metal can body is located in suction contact with the base pad spindle assembly by supplying a high volume flow of relatively low suction air to suck the bottom wall to the base pad at a first predetermined suction level. The open end of the can body is then located on the necking spindle assembly and the rotating necking and base pad spindles are rotated about their common rotational axes to spin the thusly centered can body. The open end is formed into a reduced diameter portion by radially displacing a radially outward located forming member, mounted between the turrets, into deforming contact with the open end while providing counter support against the deforming movement with at least one inner member mounted on the necking spindle assembly within the can interior. The can body is maintained on the base pad by supplying a low volume flow of vacuum air to the bottom wall to maintain such contact. This volume flow is at a lower volume than the high volume flow of low suction air but reaches the can bottom wall through the base pad at a second predetermined suction level having greater suction than the first predetermined suction level.

The methods taught by this invention also feature a step of latching to prevent movement of the outer forming member into tool-to-tool contact with the at least one inner forming member.

In a broader context, the principles of this invention may be applied in an apparatus for changing the shape of a plurality of metal products wherein the apparatus includes at least one turret mounted for co-rotation with a main turret shaft. Means is provided in the apparatus for locating the plural metal products on the turret at spaced intervals from each other. First tool means and second tool means on the turret are relatively movable toward each other for contacting the metal products to change their shape. The first and second tool means are movable such that the absence of a said metal product on the turret allows tool-to-tool contact and undesirable wearing of the forming surfaces on the first and second tools. Therefore, the improvement according to this invention comprises locking means, responsive to a signal indicative of a disruption in the supply of metal products to the apparatus, for avoiding tool-to-tool contact between the first and second tool means by preventing the second tool means from completing its entire range of movement against the first tool means.

In a broader aspect in accordance with another feature of this invention, the invention is also applicable to an apparatus for changing the shape of a plurality of metal products wherein the apparatus includes a first turret and a second turret both mounted for co-rotation with a main turret shaft. Means is provided for locating the plural metal products on the first turret at spaced intervals from each other. First tool means and second tool means on the second turret are relatively movable toward each other for contacting the metal products to change their shape. The improvement comprises means for supplying suction to the locating means for locating the plural metal products on the first turret. The suction supplying means includes first means for supplying suction under a first predetermined condition to selected ones of the locating means and second means for supplying suction under a second predetermined condition different from the first predetermined condition to others of the locating means.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF DRAWINGS

FIG. 1C is a timing diagram of the spin flow necking process carried out by the multi-station spin flow necking machine according to the present invention;

Figure 3:
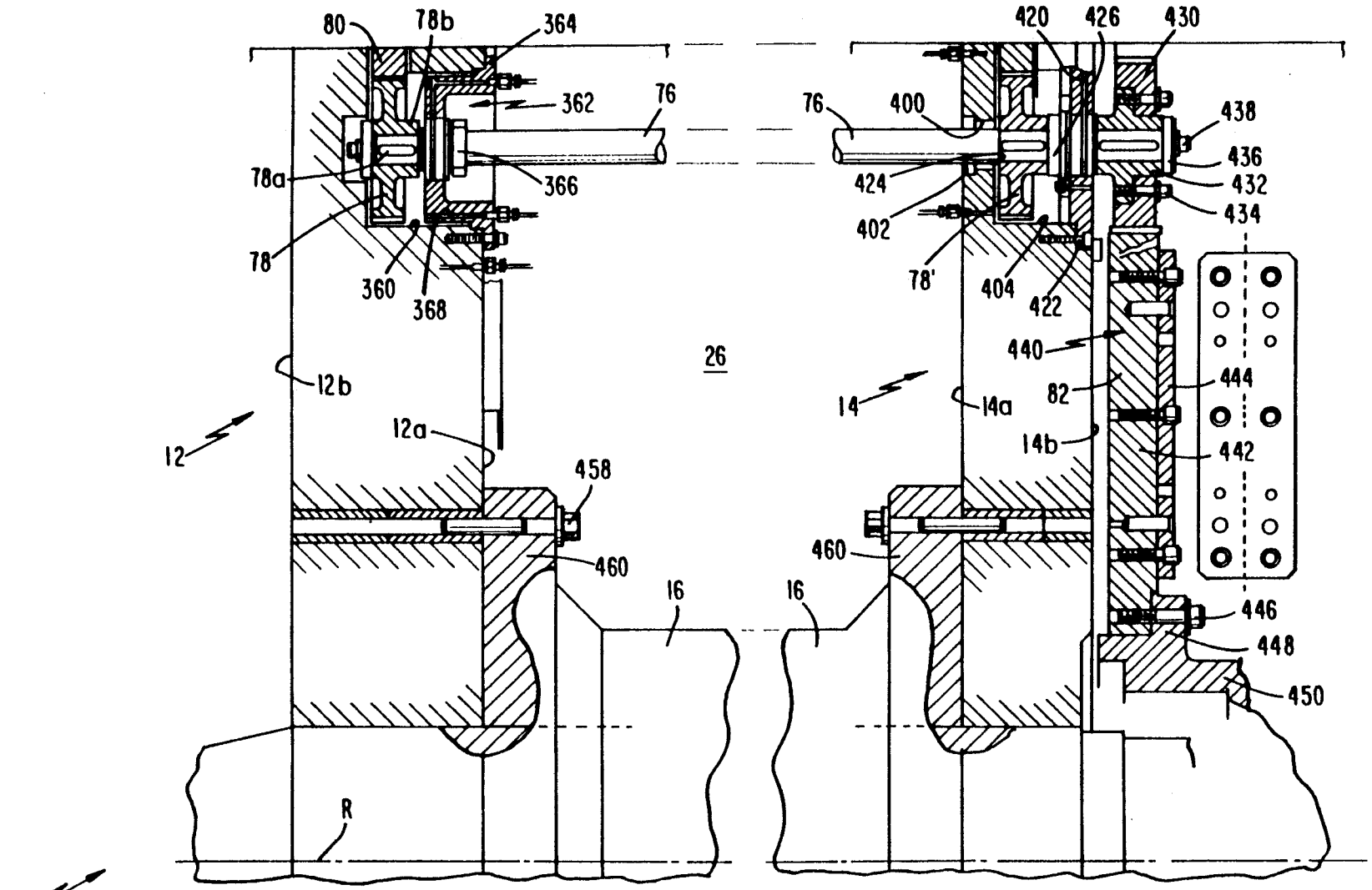
Figure 4:
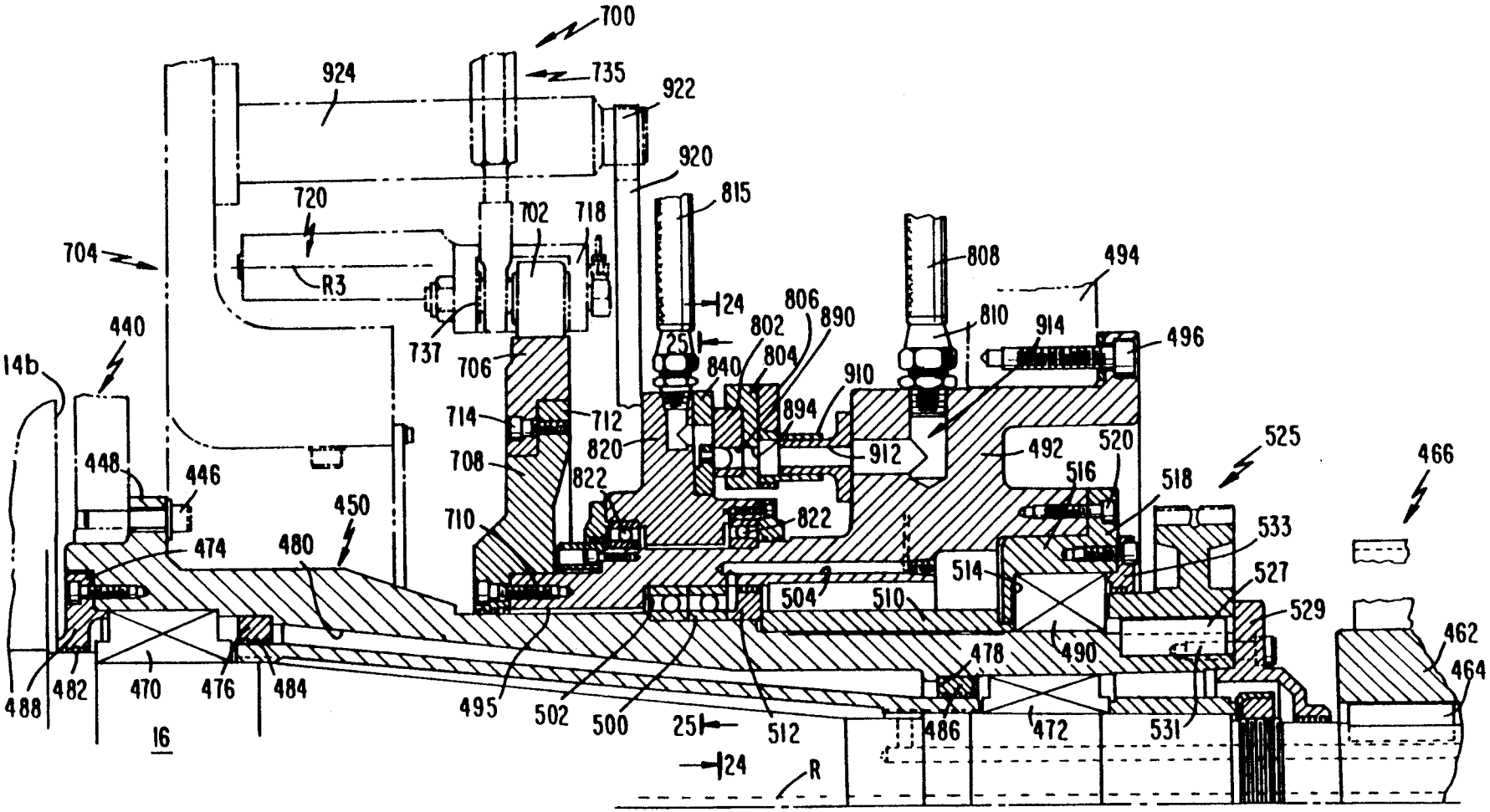
Figure 5:
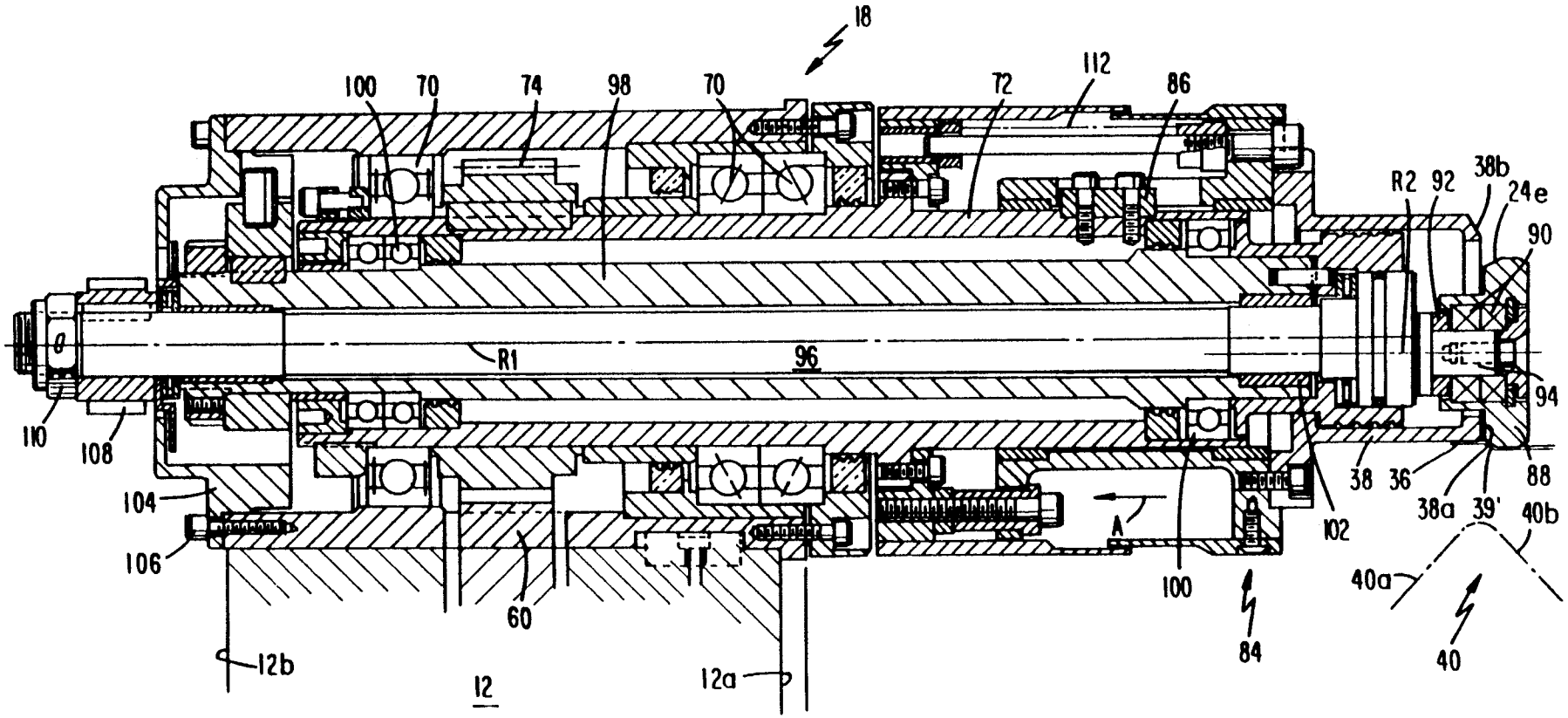
Figure 6:
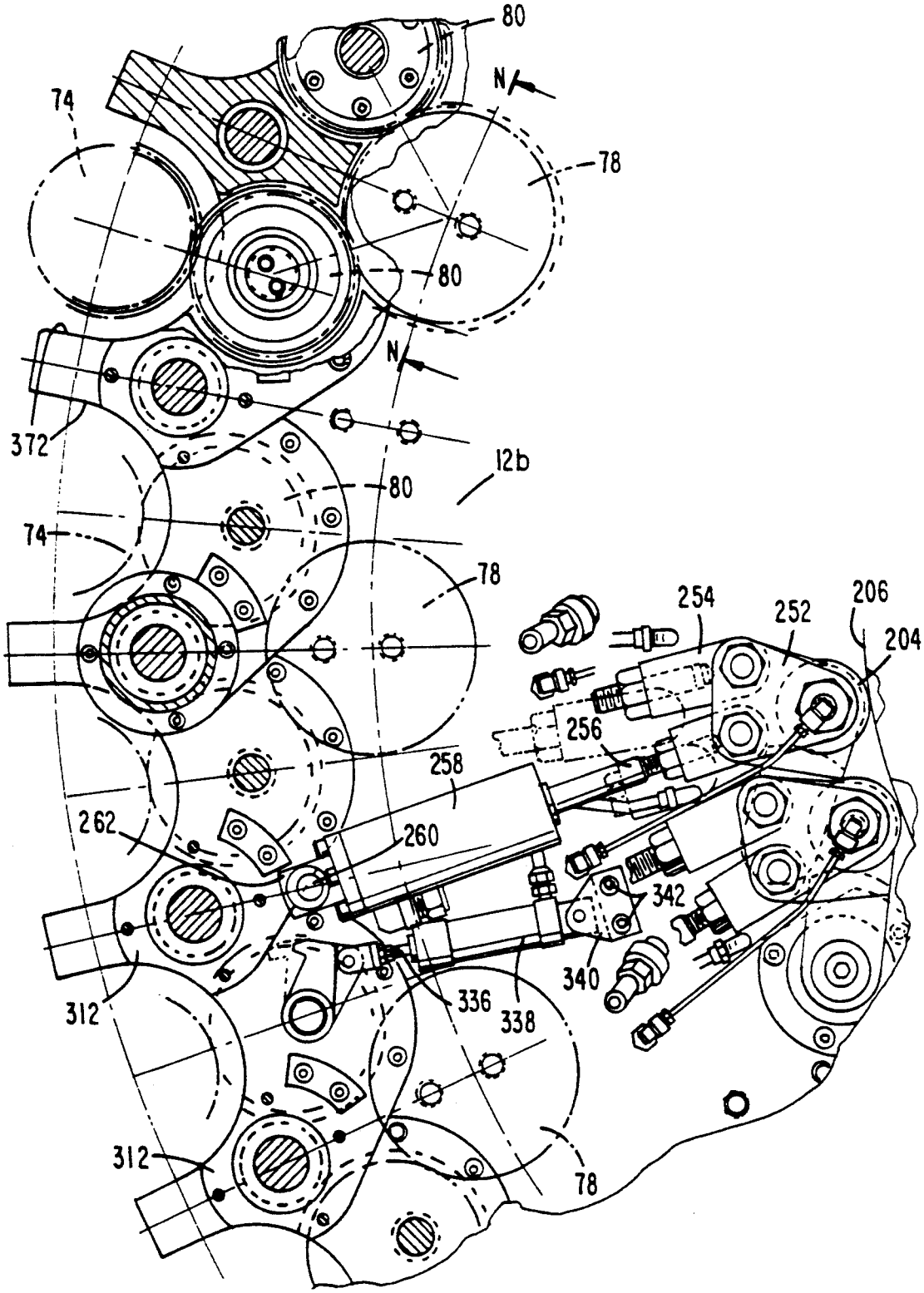
Figure 7:
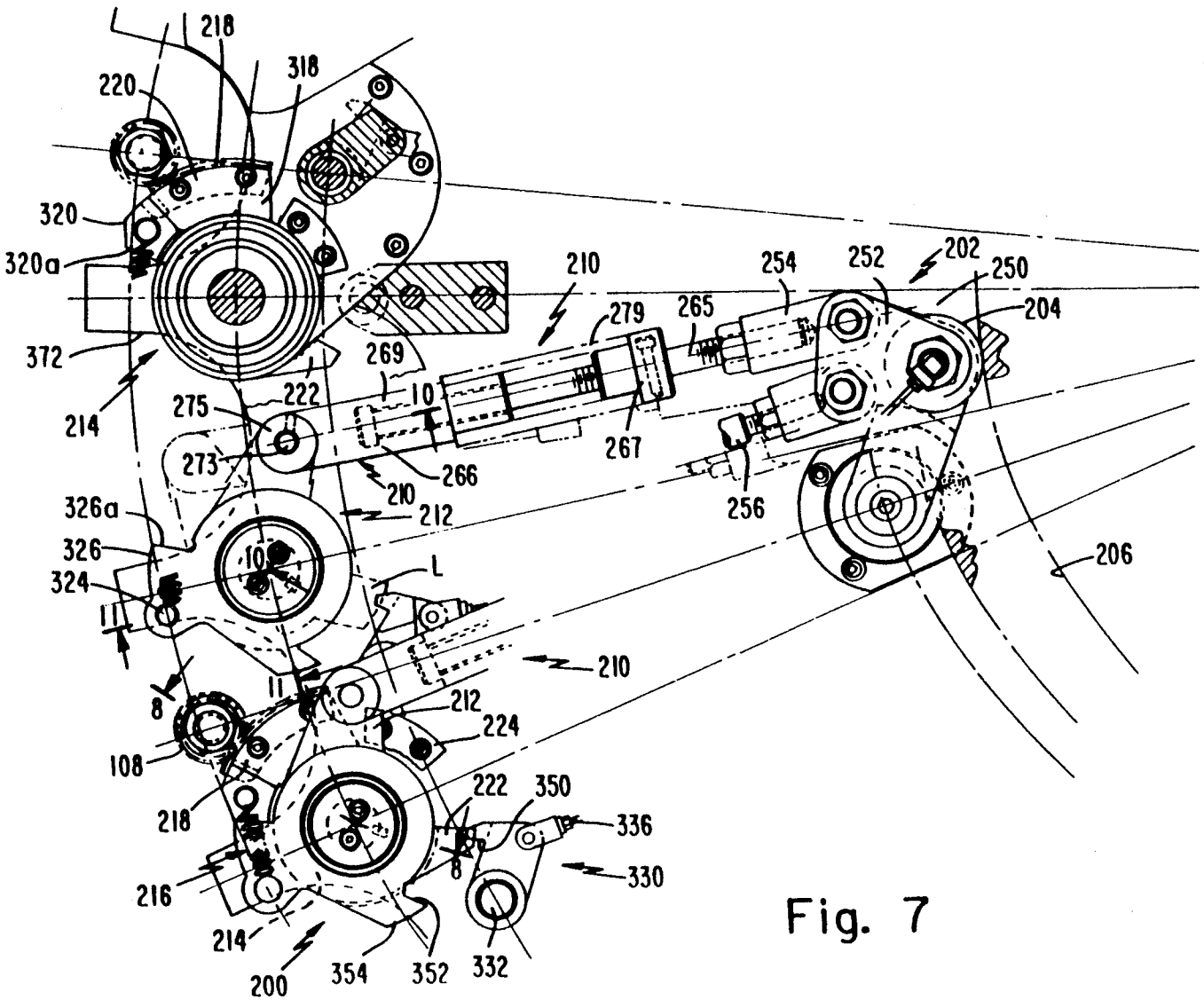
Figure 9:
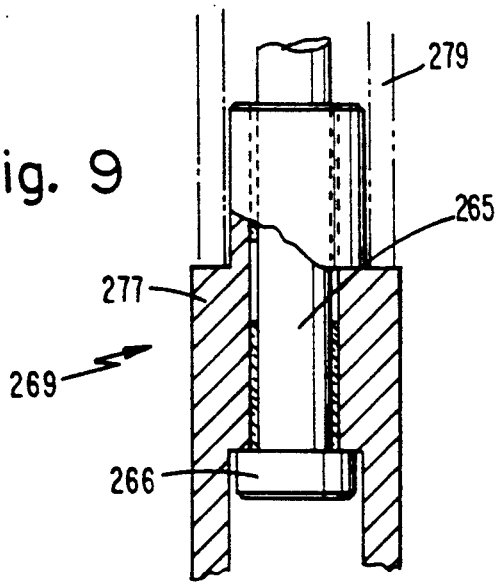
Figure 8:
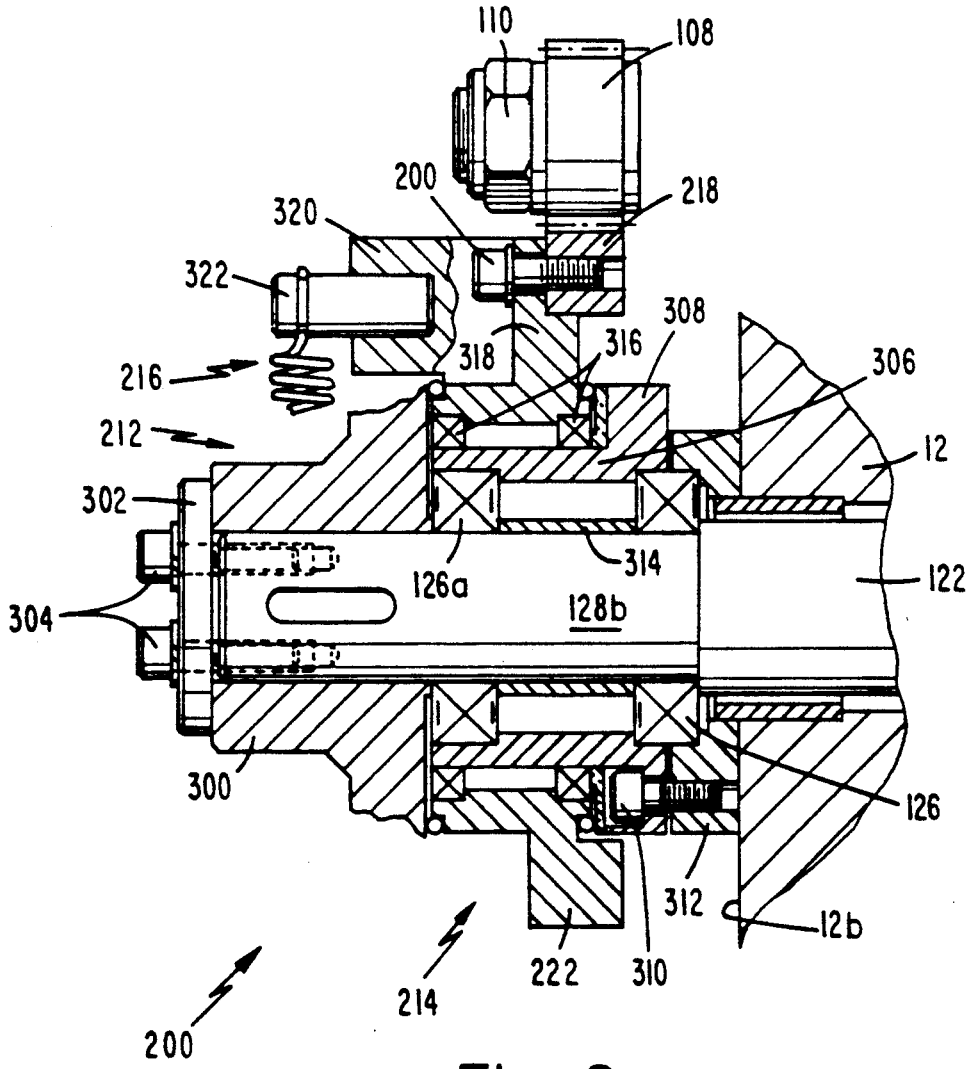
Figure 11:
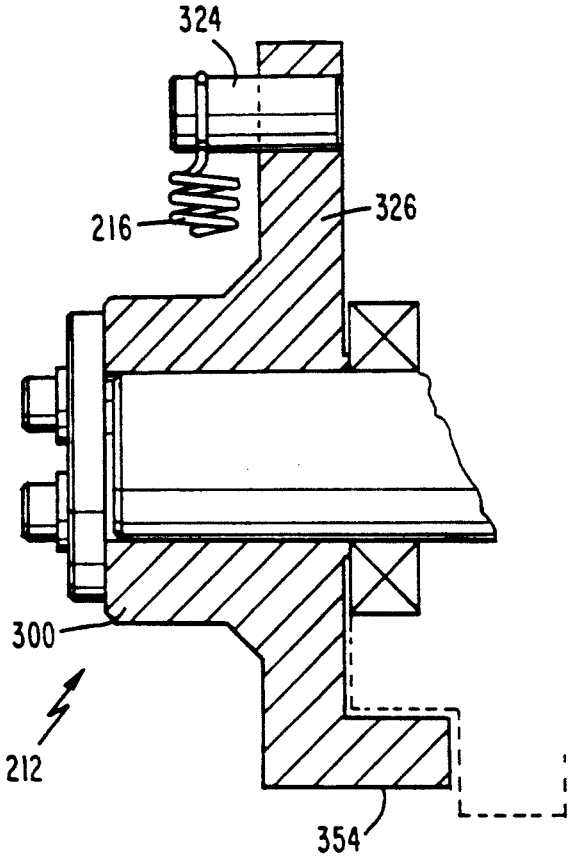
Figure 10:
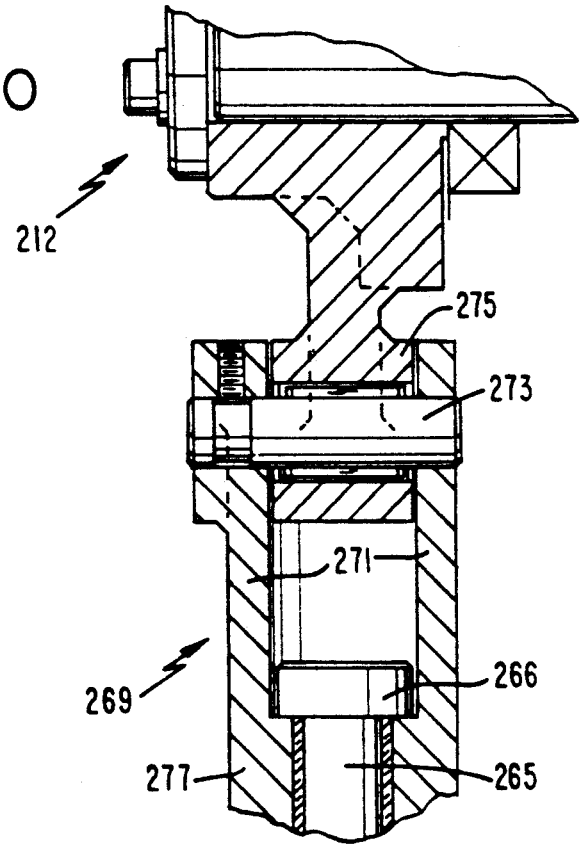
Figure 12:
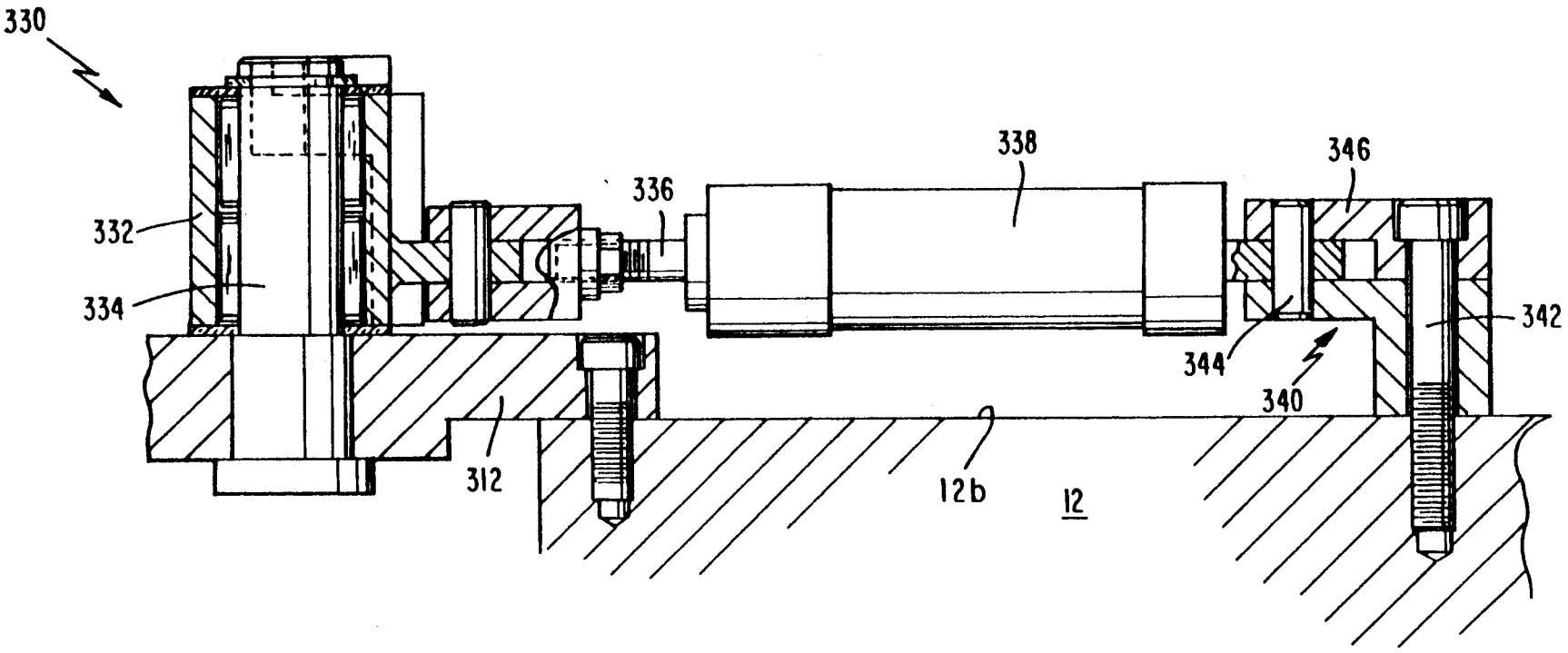
Figure 13:
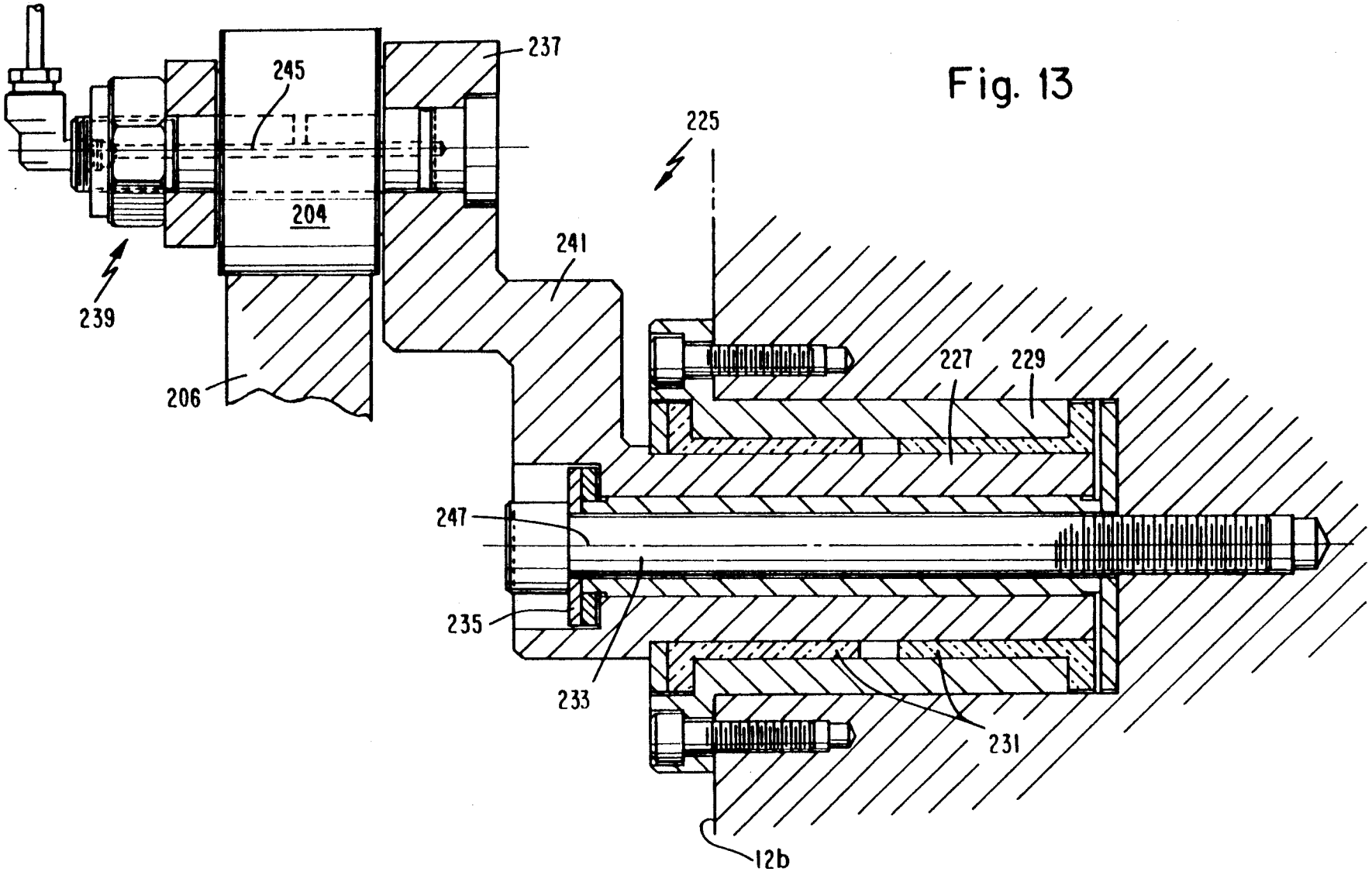
Figure 14:
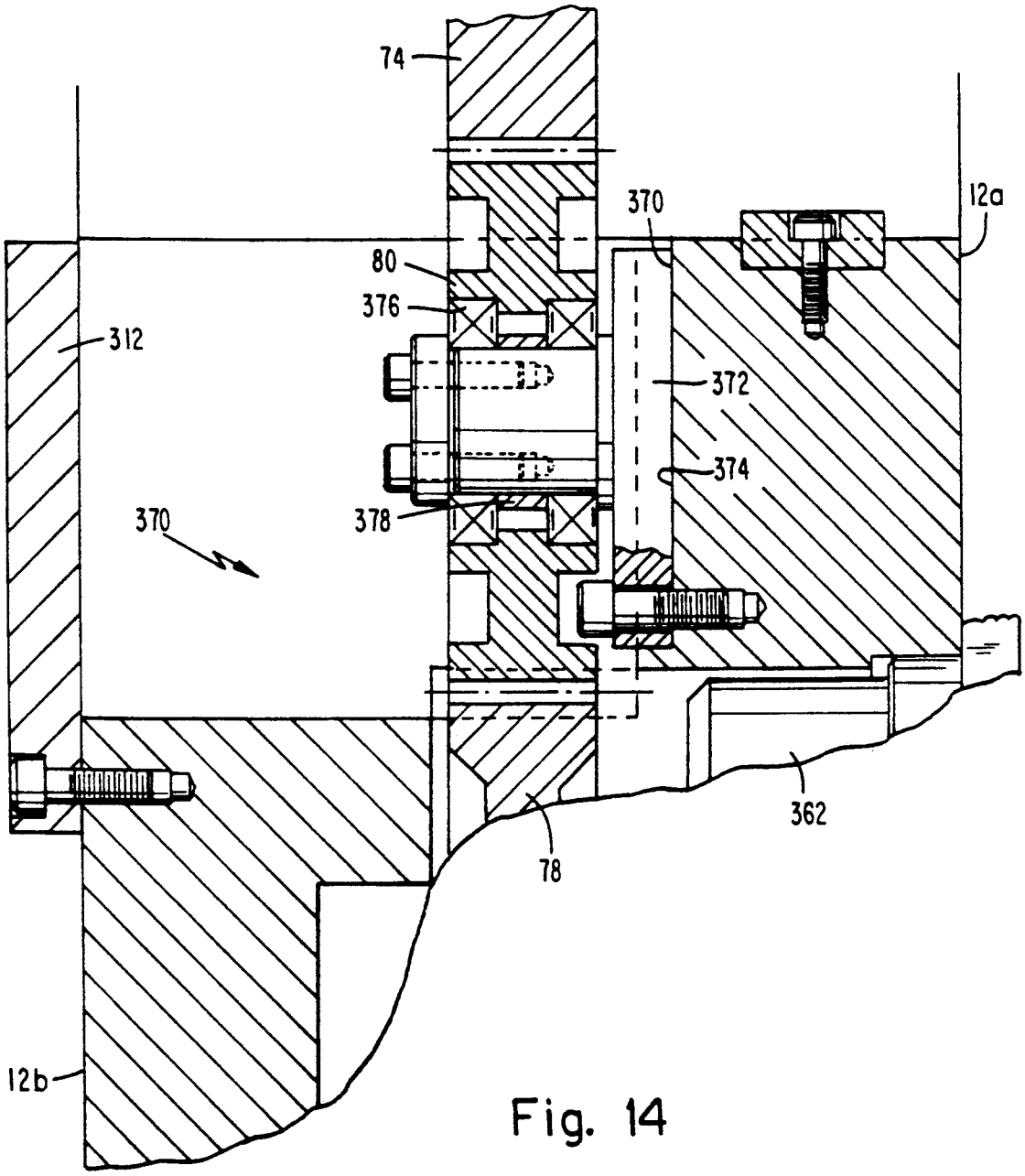
Figure 15:
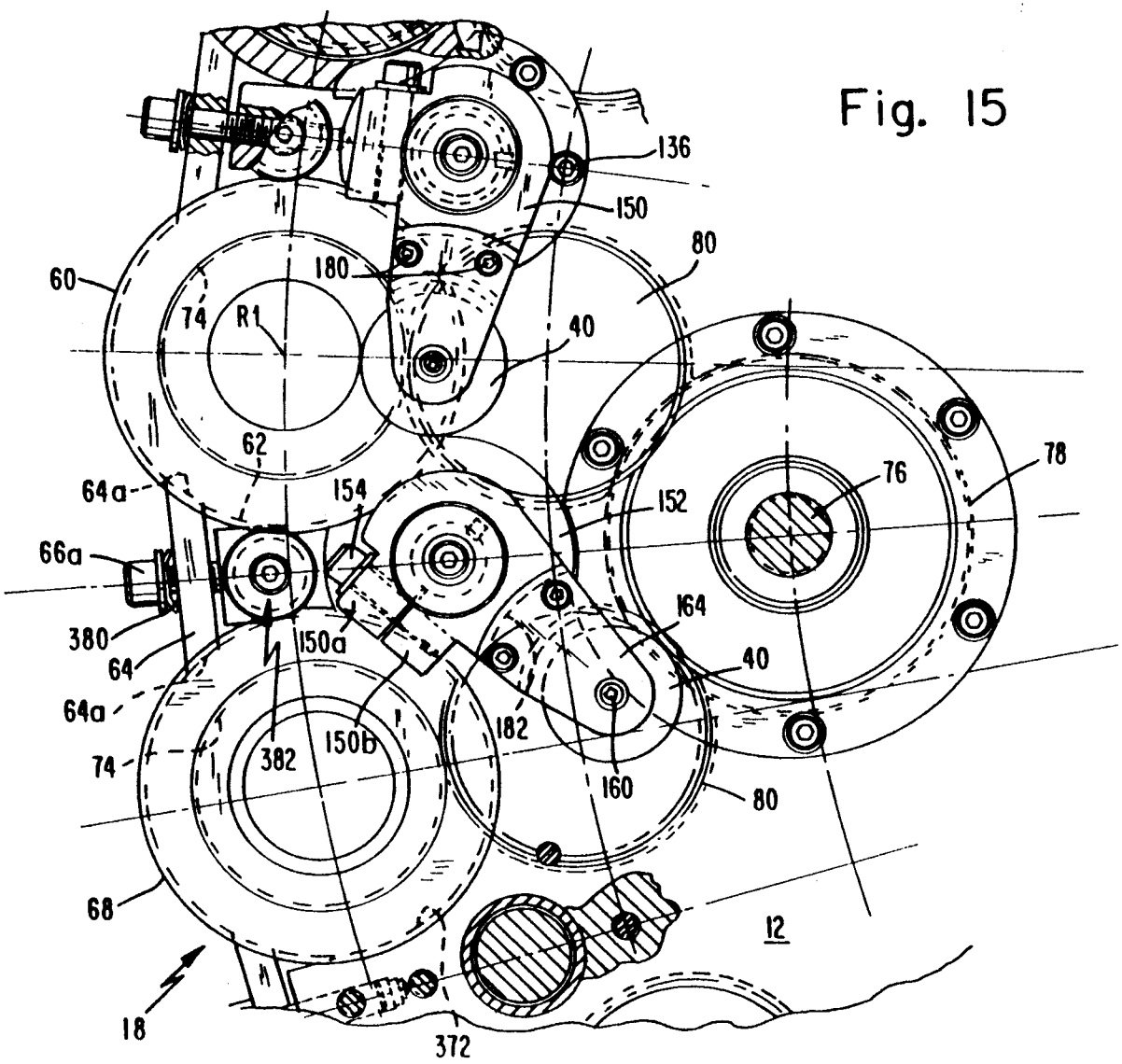
Figure 16:
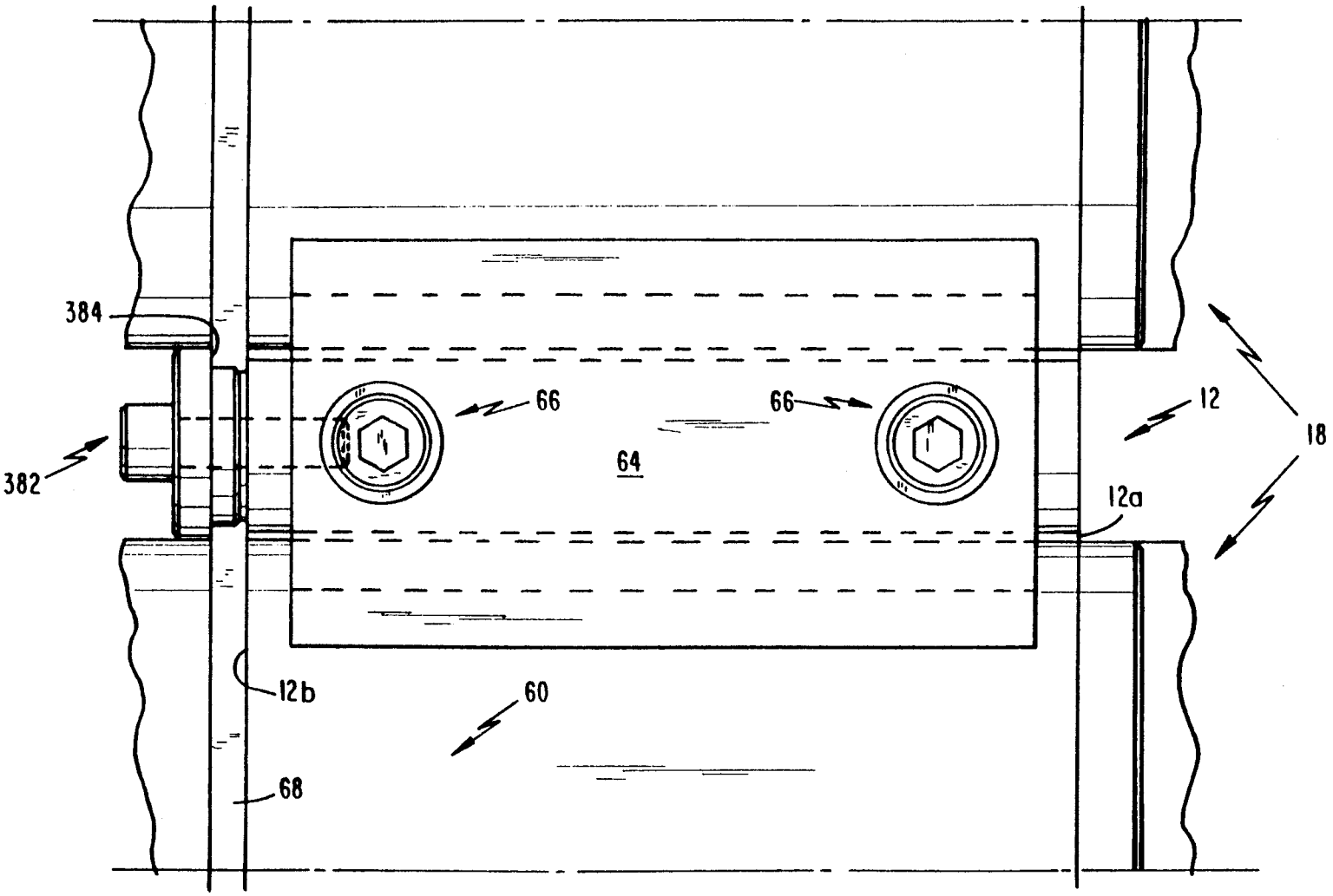
Figure 17:
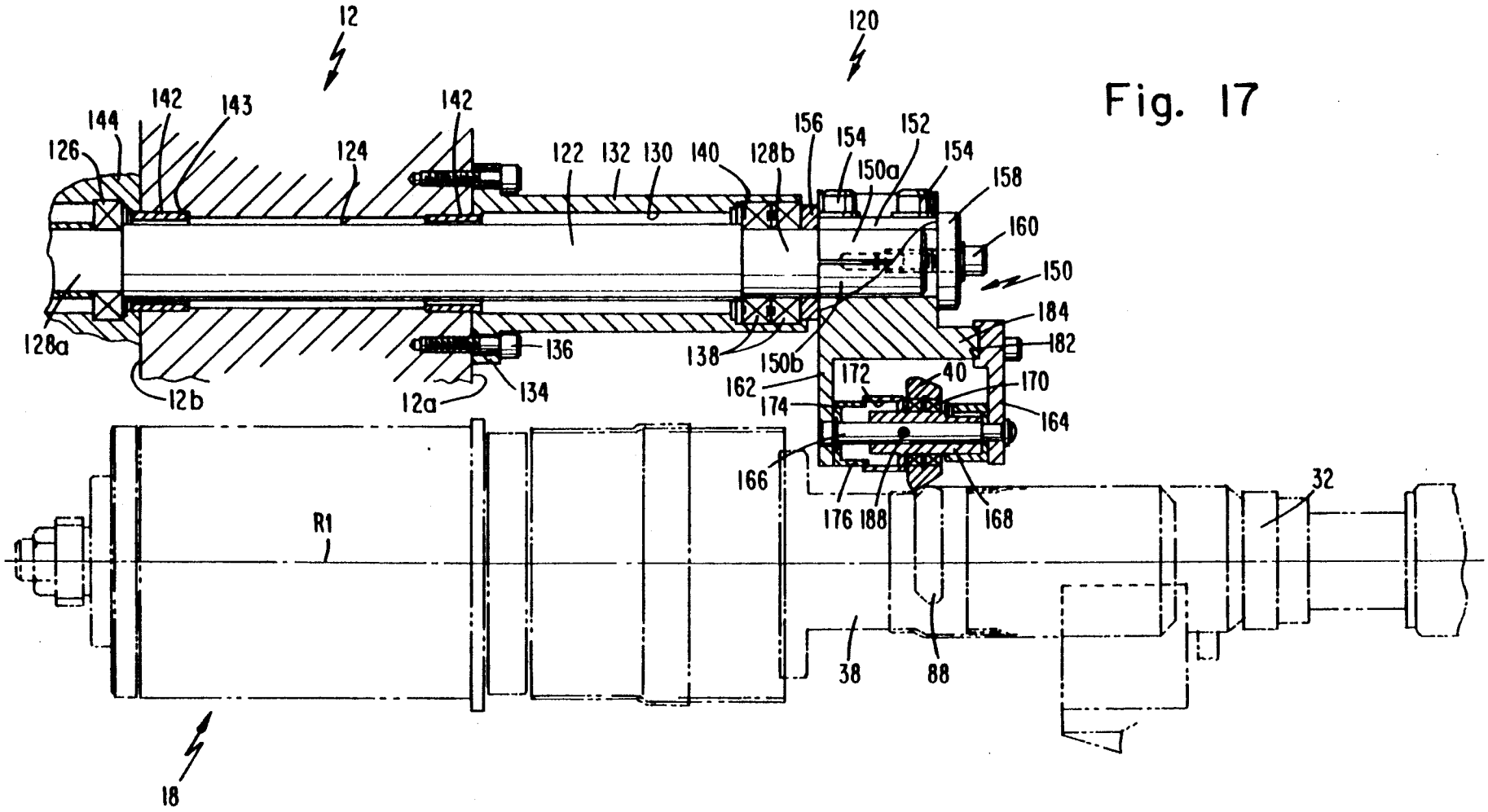
Figure 18:
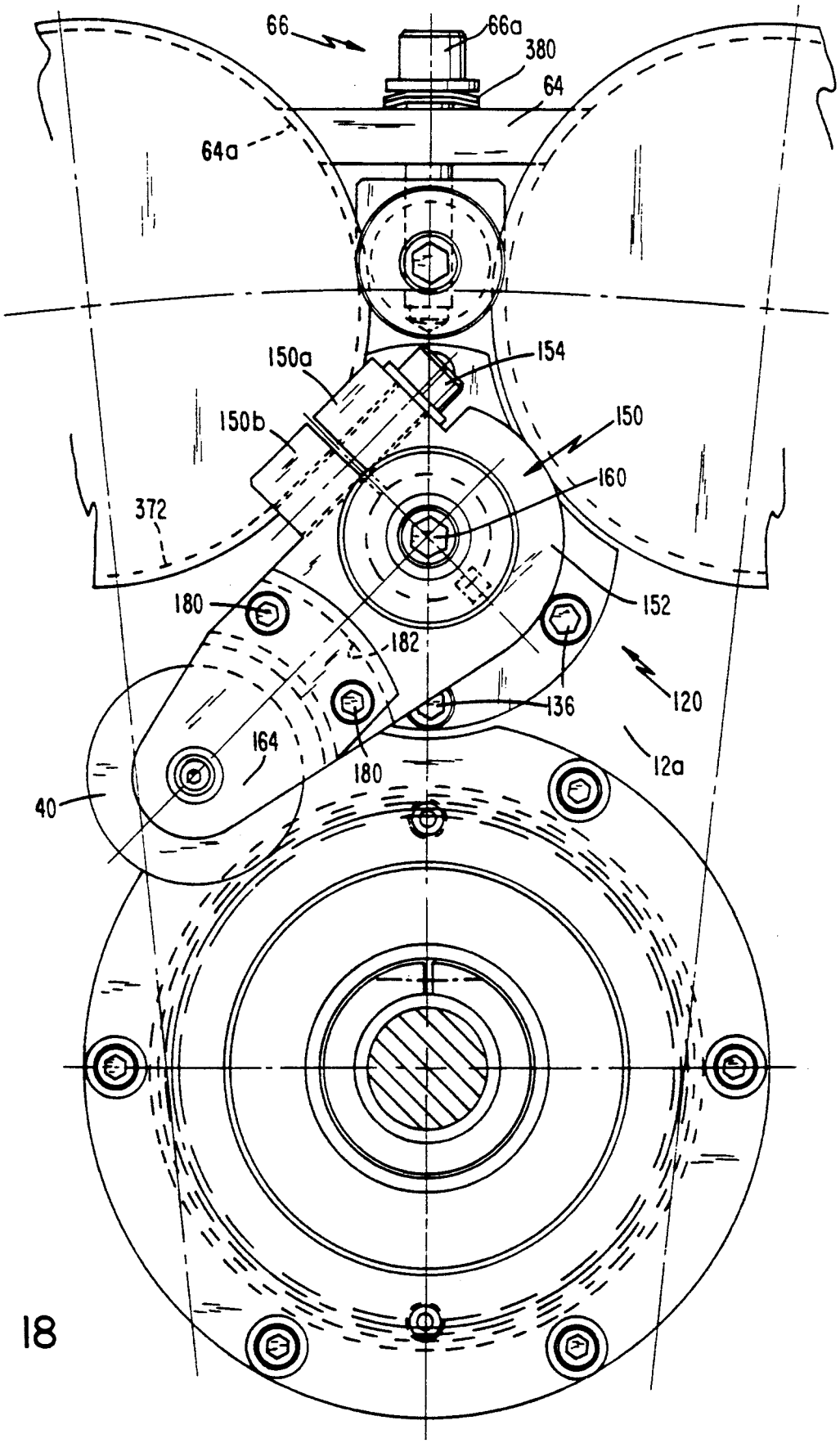
Figure 19:
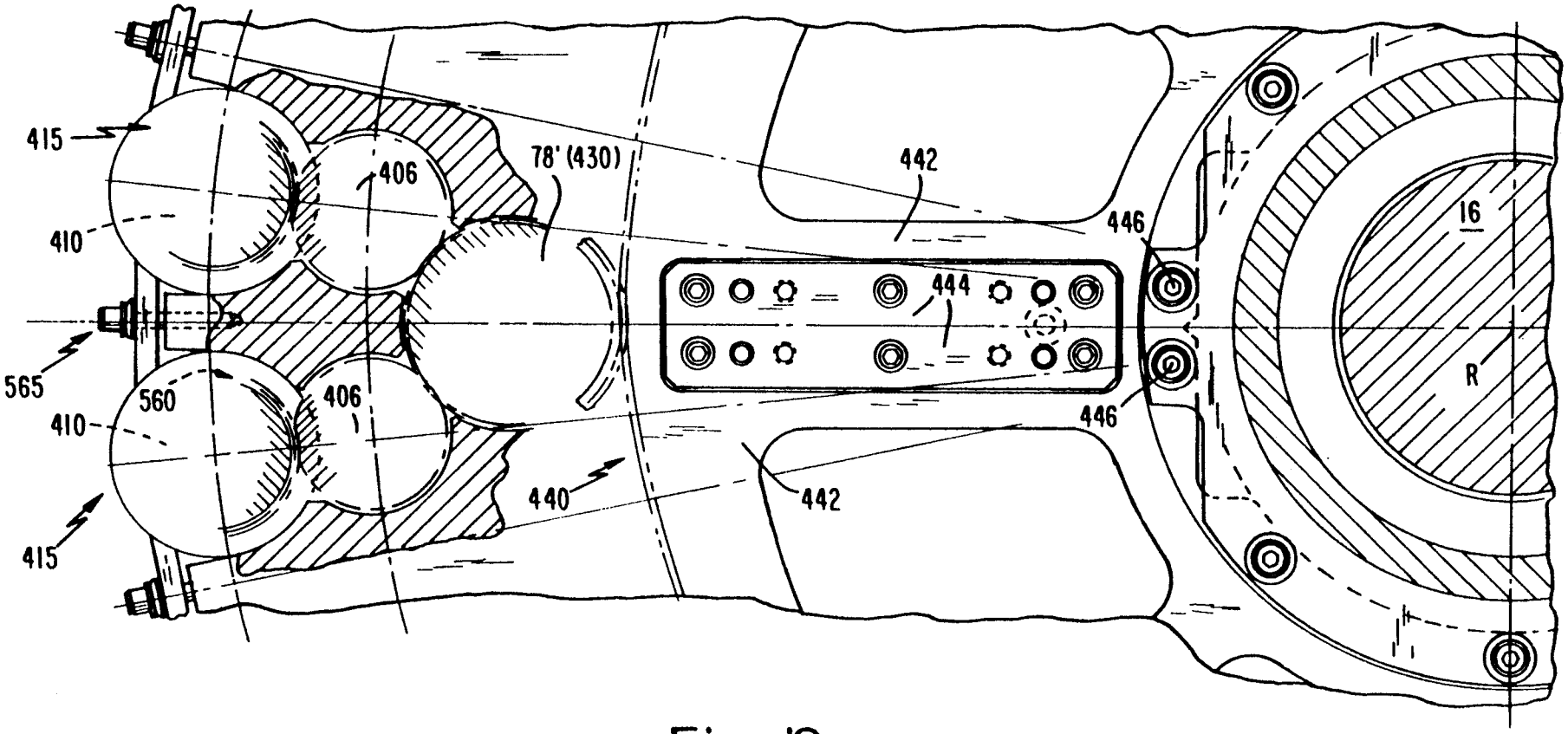
Figure 20:
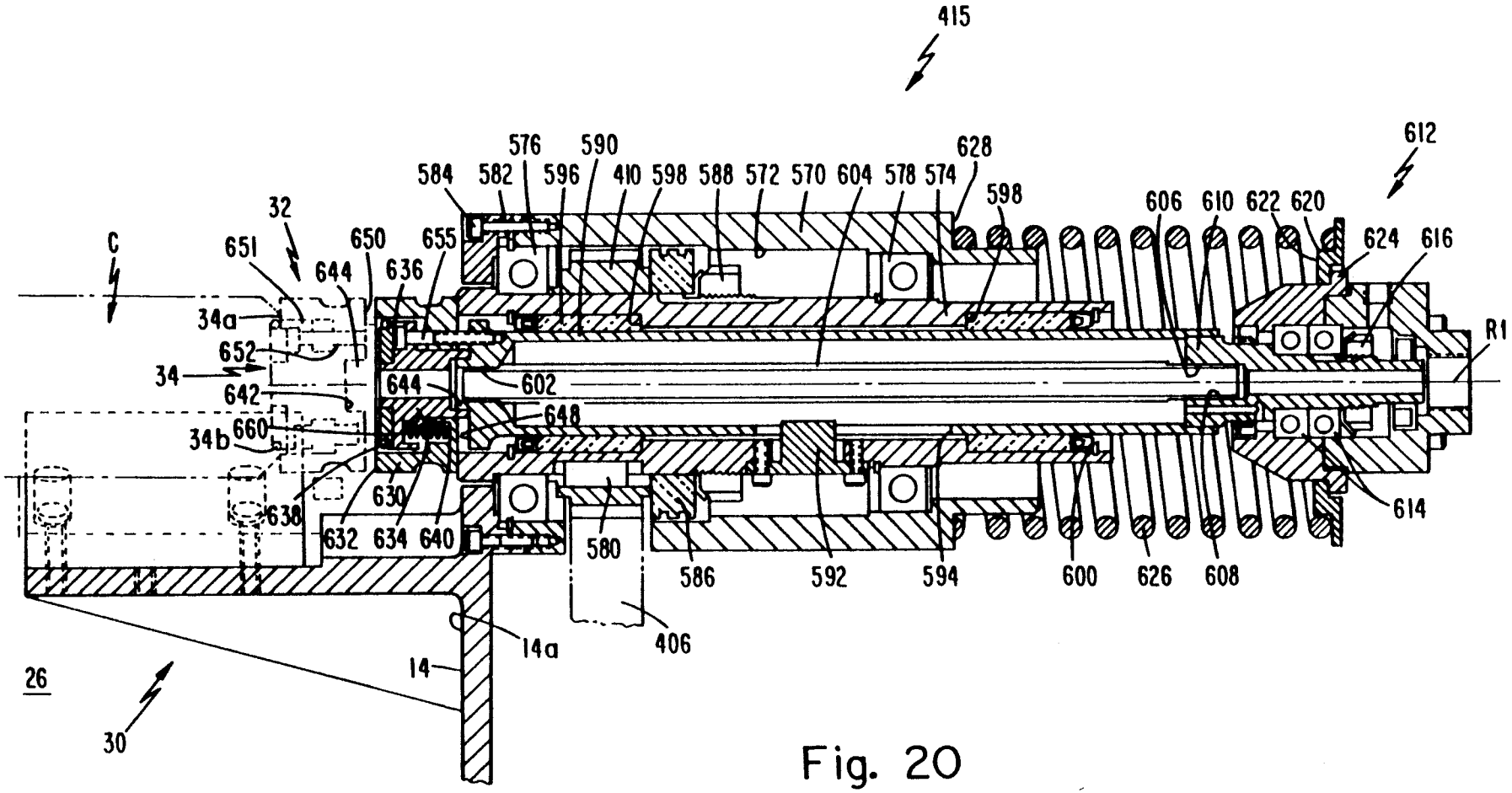
Figure 21:
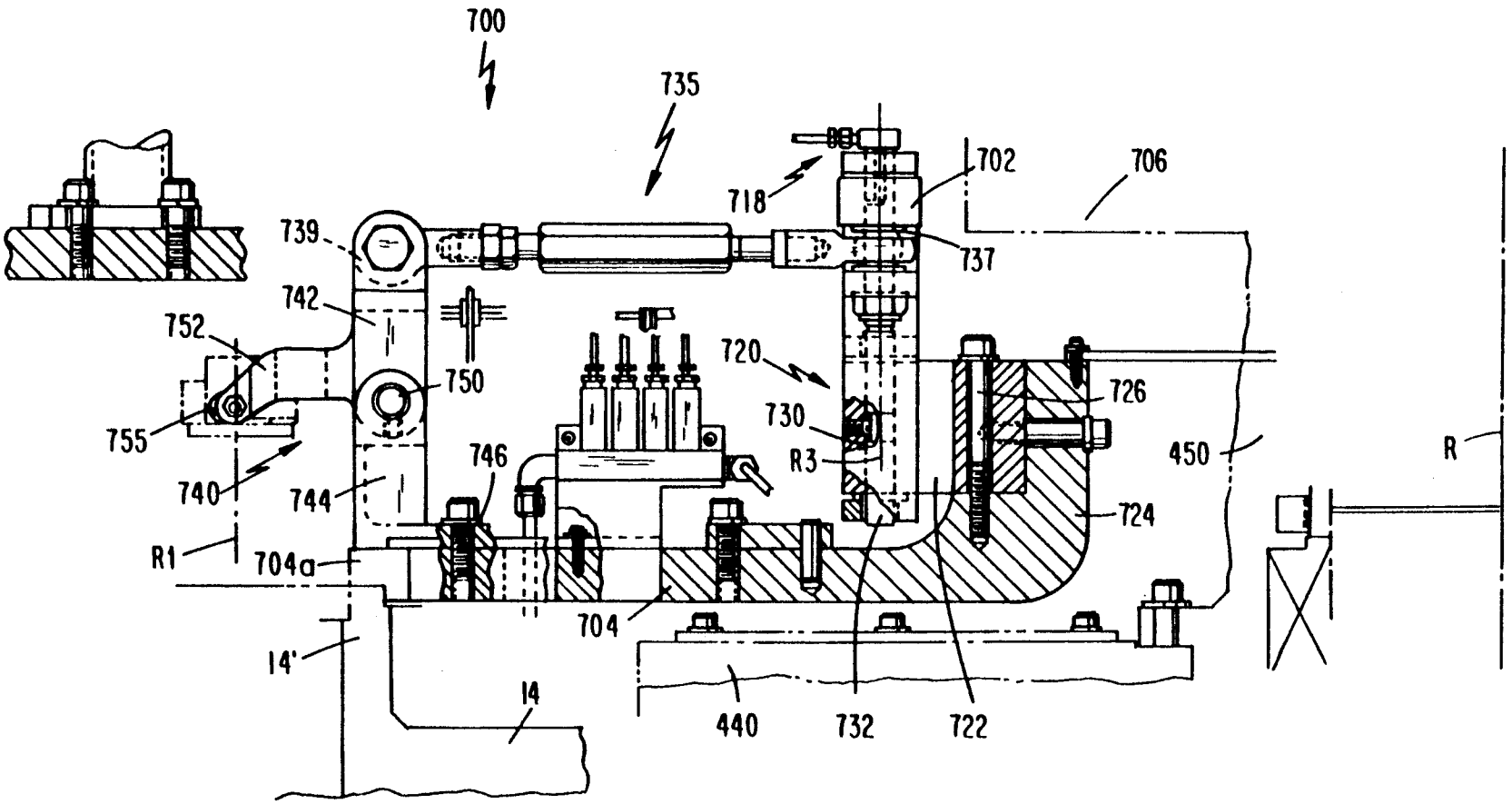
Figure 22:
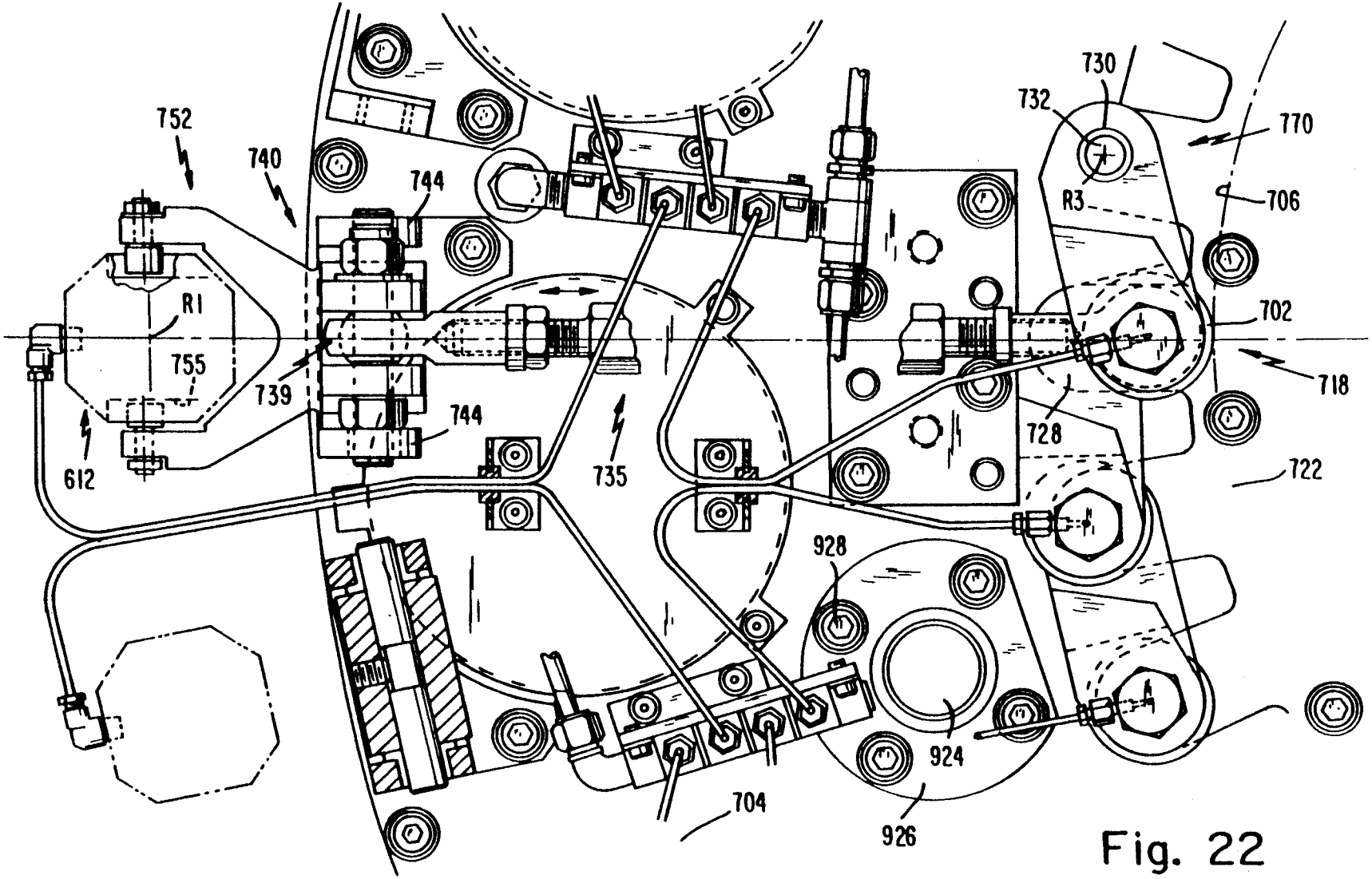
Figure 23:
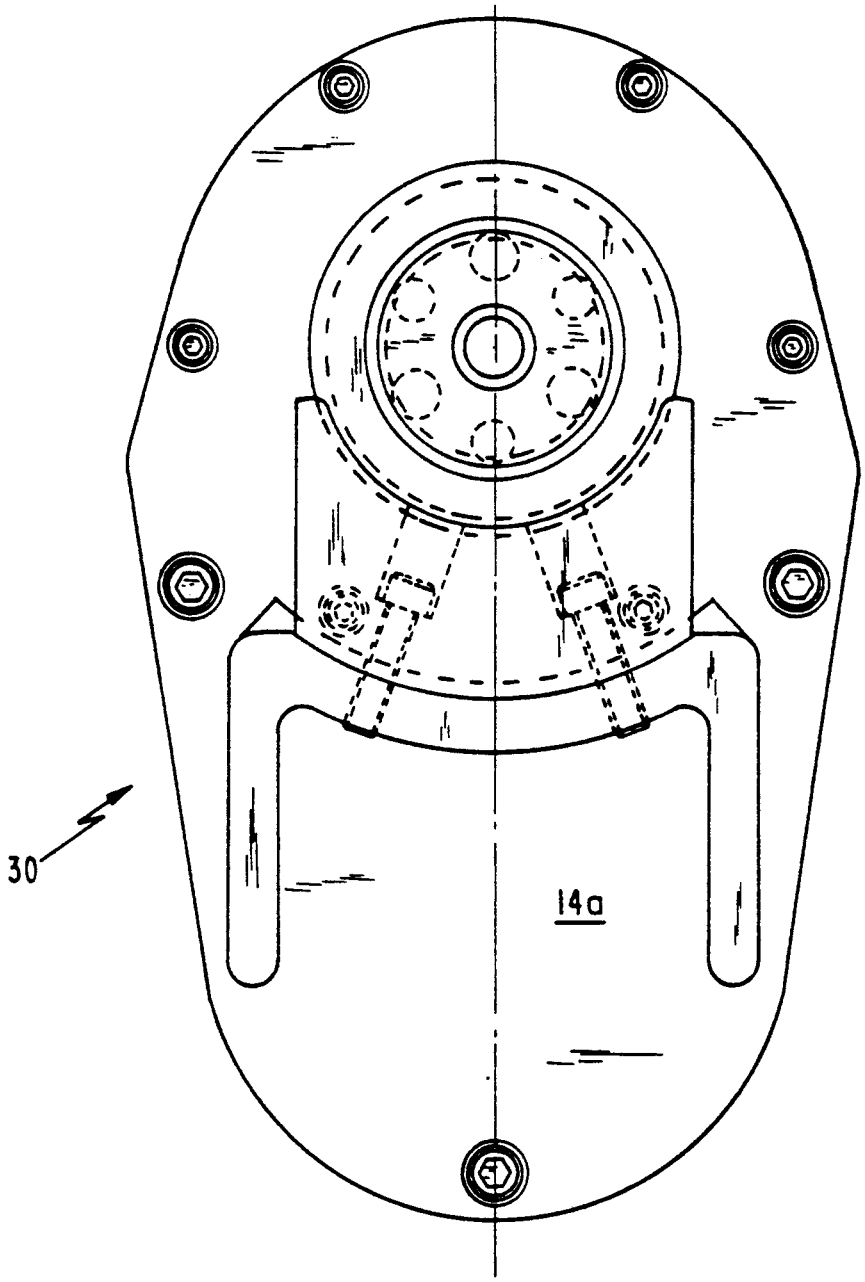
Figure 24:
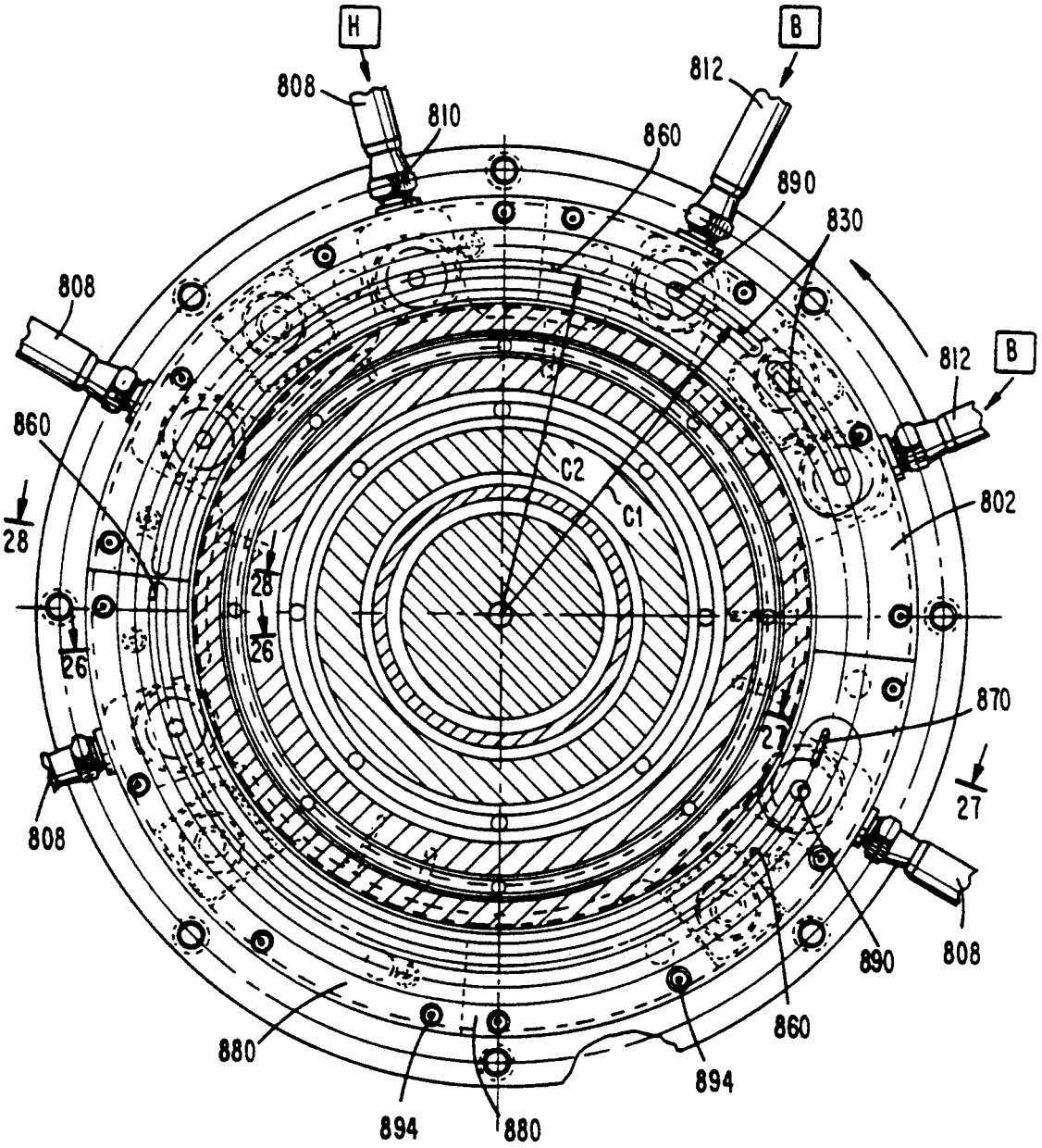
Figure 25:
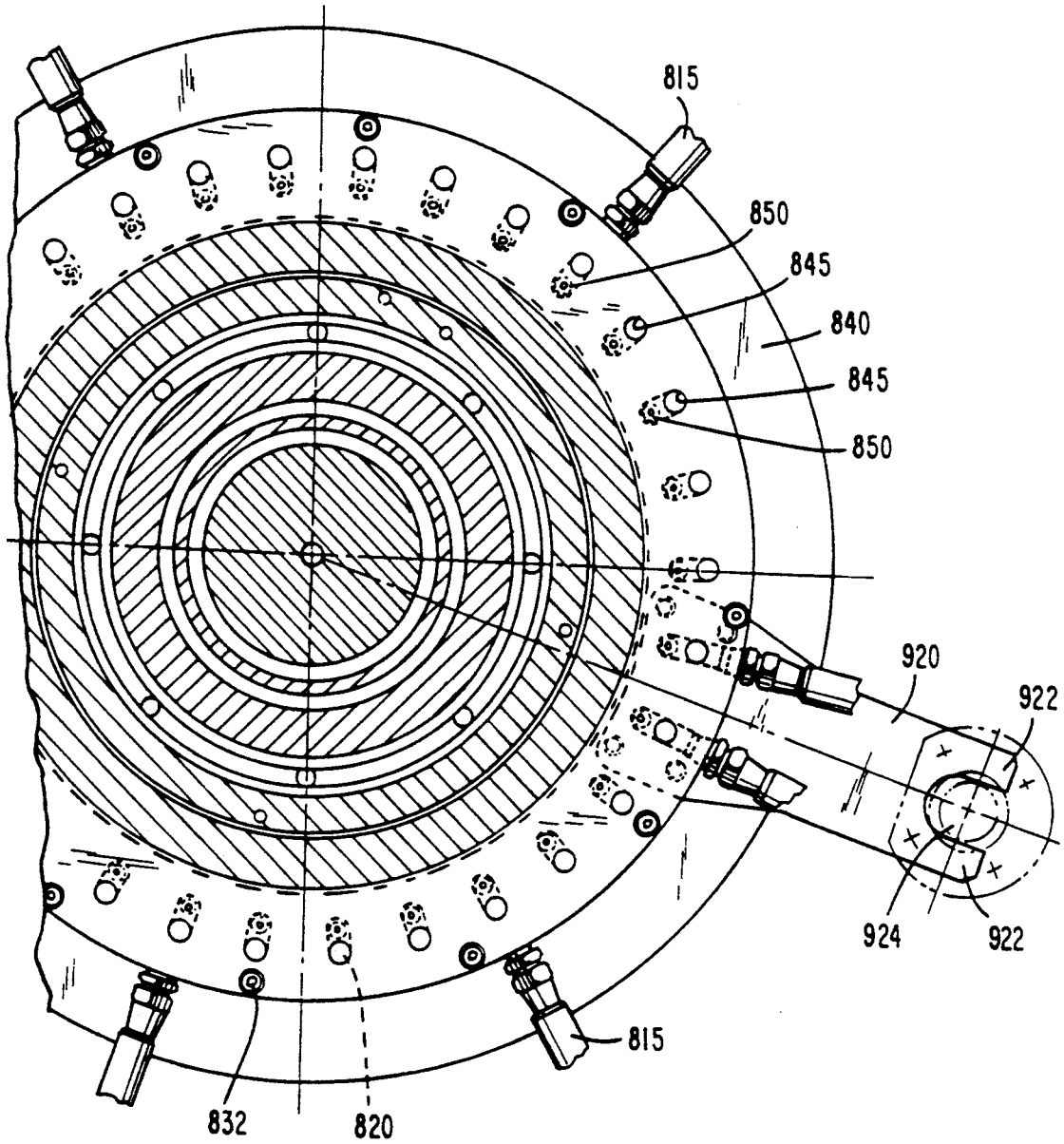
Figure 27:
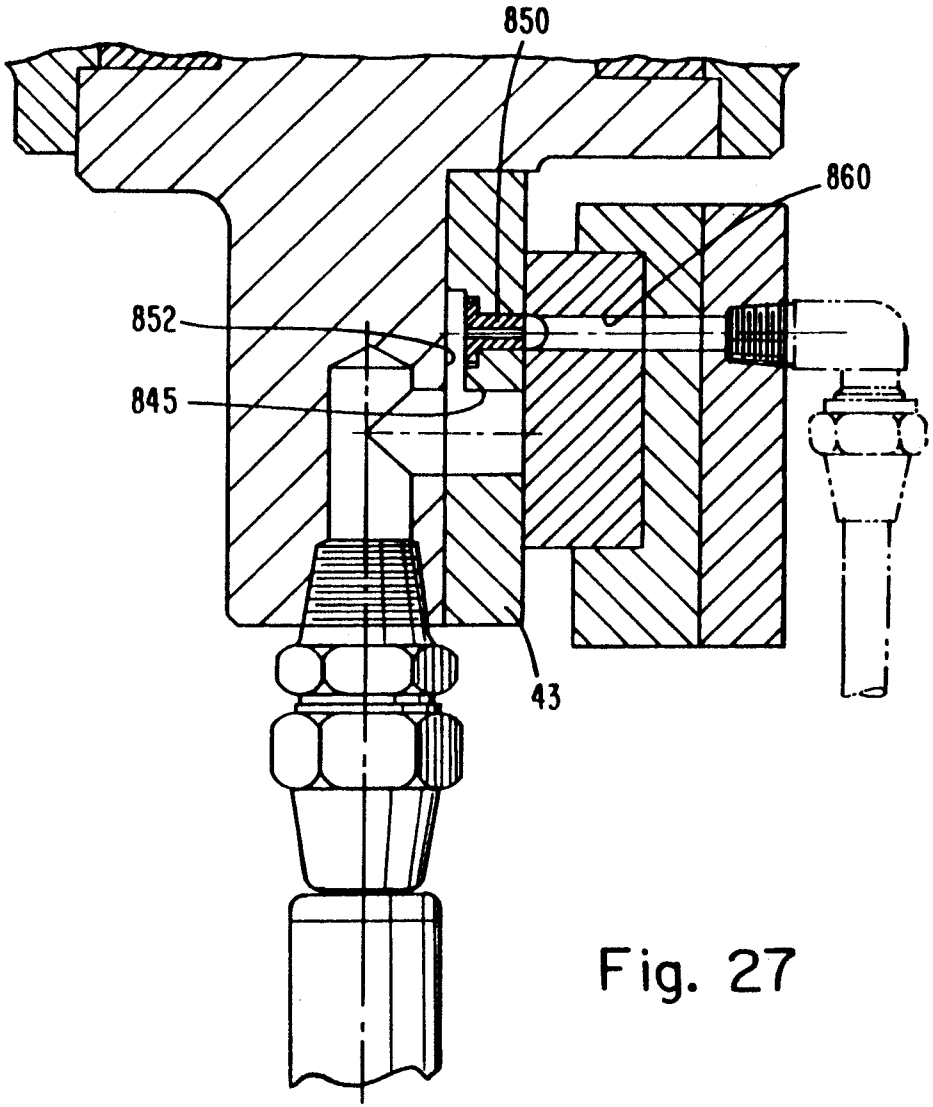
Figure 26:
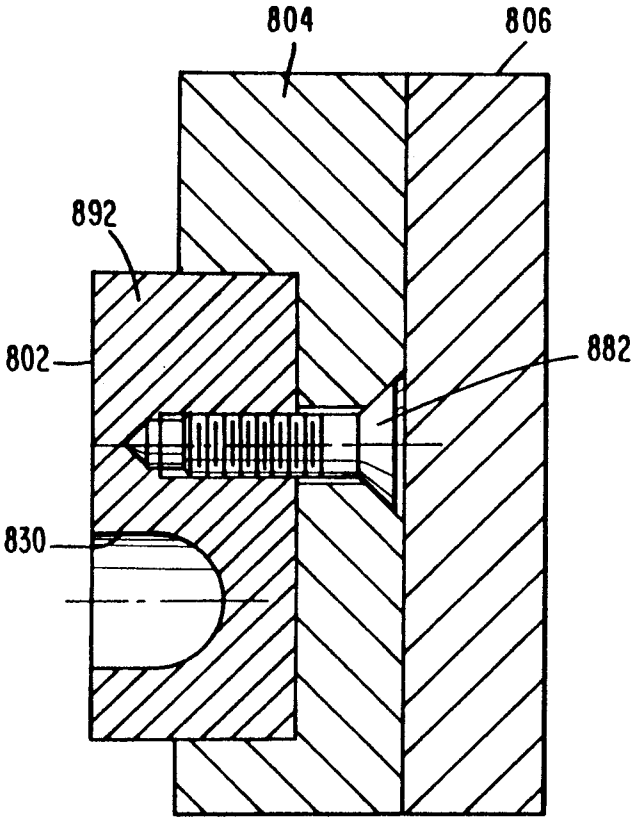

FIGS *2a* to *2j* schematically depict the relative placement and movement of various forming components and mounting assemblies of this machine;

FIG. 3 is a scaled, partial sectional view depicting the mounting of the tooling disc and base pad turrets to the main turret shaft, as well as the line shaft/line shaft gear assemblies for connecting the necking and base pad spindle gears for co-rotation;

FIG. 4 is a scaled, sectional view depicting the relative placement of the base pad vacuum manifold arrangement, line shaft and main turret drive;

FIG. 5 is a scaled, sectional view of a necking spindle assembly for use with the present invention;

FIG. 6 is a scaled, plan and partial sectional view of a rear face of the tooling disc turret to which are mounted cam controlled necking spindle activating and latching assemblies according to this invention;

FIG. 7 is a scaled view similar to FIG. 6 depicting several of the activating and latching assemblies with certain components removed for clarity of illustration;

FIG. 8 is a scaled, sectional view taken along the line 8—8 of FIG. 7;

FIG. 9 is a scaled, partial sectional view of a portion of a lost motion arrangement used in each activating and latching assembly;

FIG. 10 is a scaled, sectional view taken along the line 10—10 of FIG. 7;

FIG. 11 is a scaled, sectional view taken along the line 11—11 of FIG. 7;

FIG. 12 is a scaled, partial sectional view of a latch mechanism associated with each tool activating and latching assembly;

FIG. 13 is a scaled, partial sectional view of a representative cam follower of each assembly;

FIG. 14 is a scaled, sectional view of the mounting relationship between the idler gears with the spindle and line shaft gears;

FIG. 15 is a scaled plan view of the inner face of the tooling disc turret to depict the relative locations of the necking spindles, and the outer form rolls with the line shaft gears;

FIG. 16 is a scaled, partial sectional view depicting a detail of the necking spindle clamping arrangement;

FIG. 17 is a scaled, detailed sectional view of the tooling disc turret mounts for the outer form roll assemblies;

FIG. 18 is a scaled plan view depicting another feature of the outer form roll mounting assembly;

FIG. 19 is a scaled partial plan, partial sectional view of the gear drive for the necking and base pad spindles;

FIG. 20 is a scaled, sectional view of a base pad spindle assembly;

FIG. 21 is a scaled, partial sectional view of a cam controlled base pad spindle connecting arrangement for reciprocating each base pad;

FIG. 22 is a scaled, rear plan view of the connecting arrangement of FIG. 21;

FIG. 23 is a scaled, front plan view of a base pad spindle;

FIG. 24 is a scaled view taken along the line 24—24 of FIG. 4 to depict a plan view of the vacuum manifold distribution ring;

FIG. 25 is a scaled, sectional view taken along the line 25—25 of FIG. 4 to depict a portion of the rotating wear plate in plan view;

FIG. 26 is a scaled view taken along the line 26—26 of FIG. 24 to depict the mounting of the manifold distribution ring to its support;

FIG. 27 is a scaled view taken along the line 27—27 of FIG. 24; and

Figure 28:
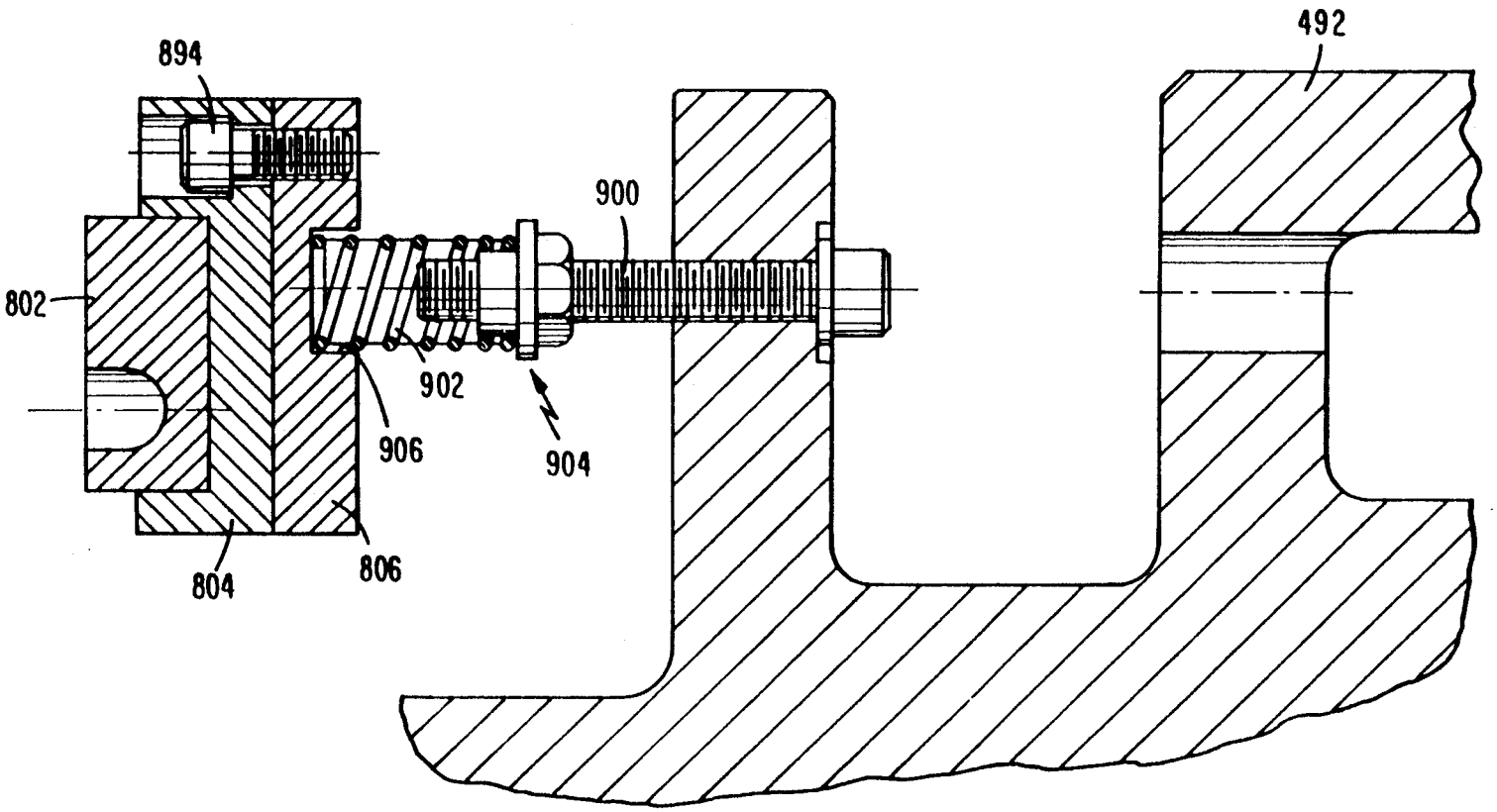

FIG. 28 is a scaled sectional view taken along the line 28—28 of FIG. 24.

BEST MODE FOR CARRYING OUT THE INVENTION

Overview

Figure 1A:
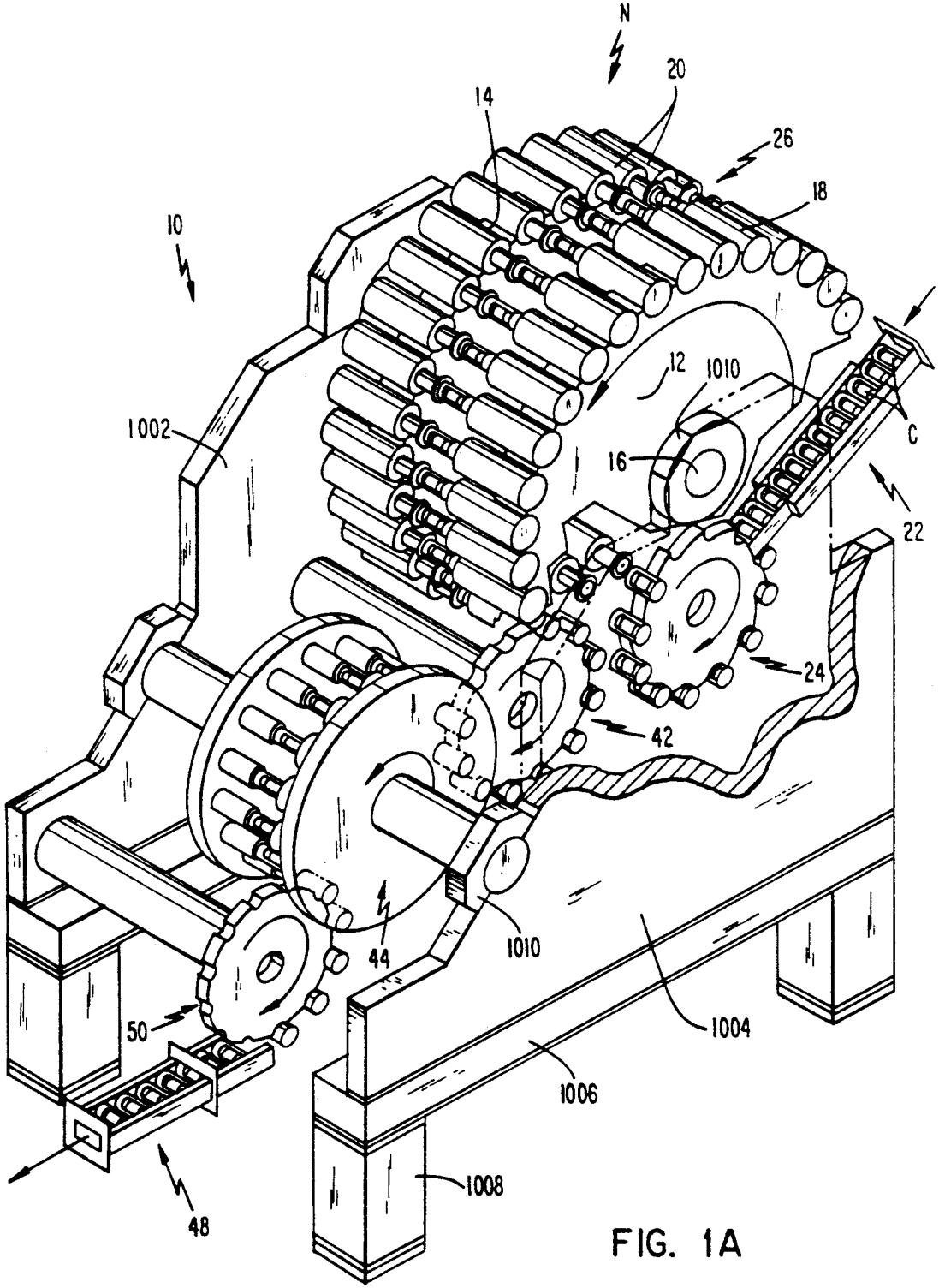
FIG. 1A is a perspective view of a spin flow necking machine according to the present invention.
Figure 1B:
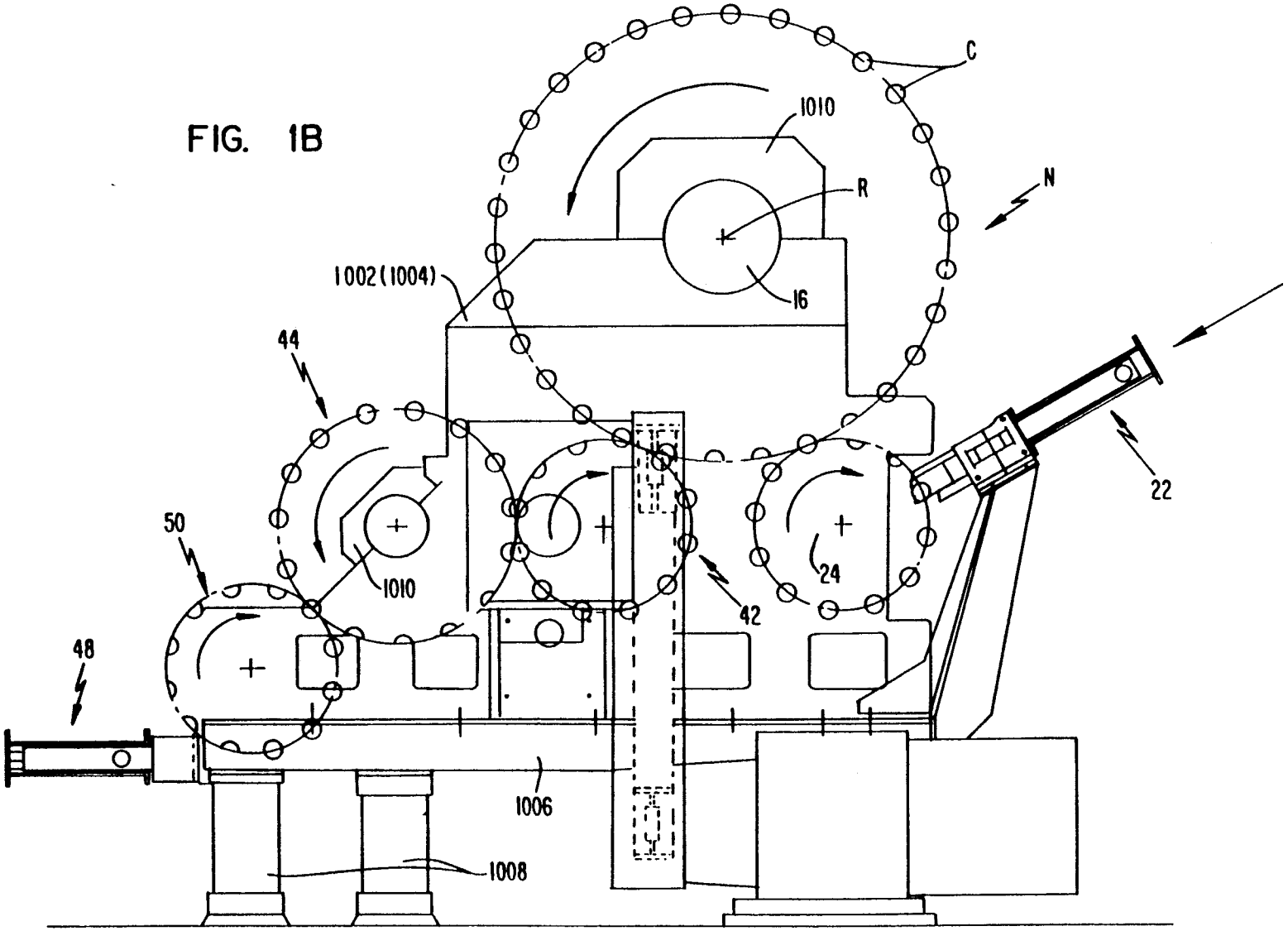
FIG. 1B is a side elevational view, in partial schematic form, of the machine in FIG. 1A.
Figures 2A, 2B, 2C, 2D, 2E, 2F:
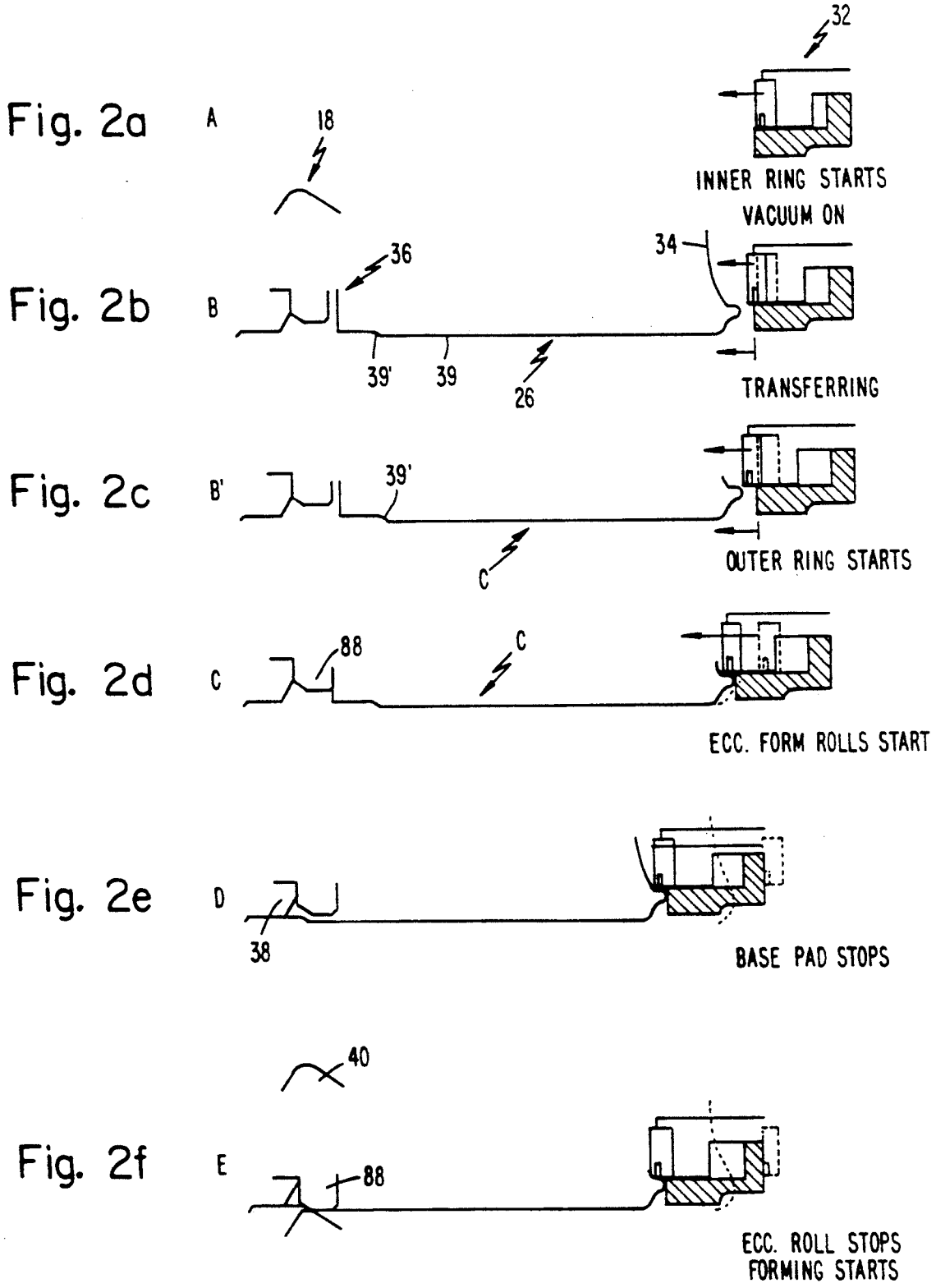
Figure 2G:
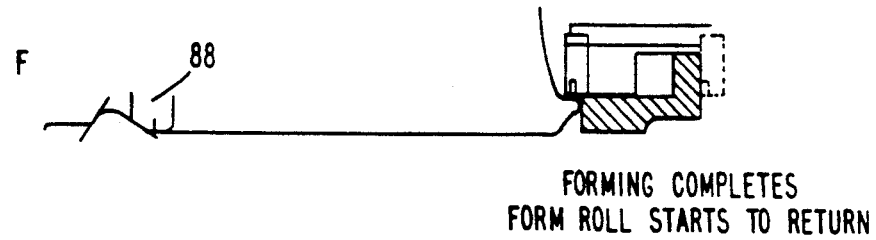
Figure 2H:
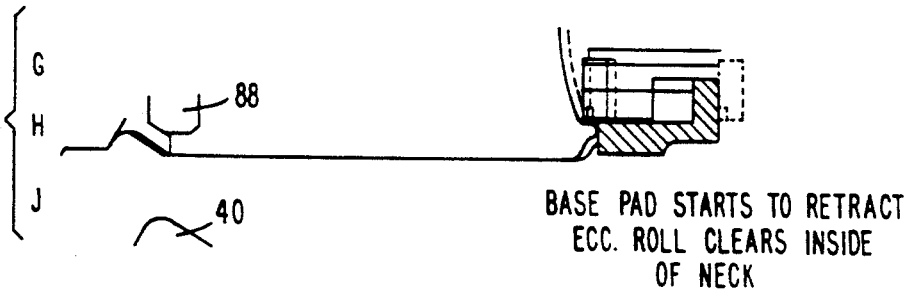
Figure 2I:
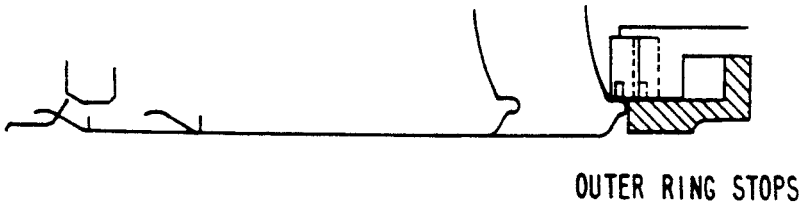
Figure 2J:
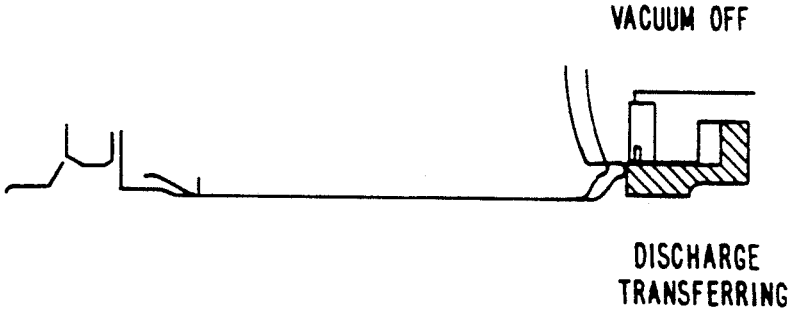

FIGS. 1A and 1B are illustrations of a spin flow necking machine 10 of the present invention which is used to perform the final step in the aluminum can forming process by receiving decorated cans (which may be pre-necked) from the line, forming a smooth neck and a seaming flange, and discharging the finished necked cans to the line for testing and shipping. Briefly, cans C enter machine 10 through an air assisted infeed chute 22 and are picked up by a vacuum infeed star wheel 24. Cans C are then transferred to a main necking turret N where spin flow necking is performed. After necking, the cans are picked up by a vacuum transfer star wheel 42 and passed to the flanging turret 44 where a flange is formed in the periphery of the can side wall defining the open end. The finished cans are passed on to a vacuum discharge star wheel 50 and released to an air-assisted discharge chute 48 for delivery to an inspection station by a plant conveying system (not shown).

The main necking turret N, which performs the spin flow necking process, preferably consists of a steel shaft 16 which mounts two large cast aluminum discs 12 and 14. One of the discs 12 is a tooling disc which carries the spin flow necking assemblies 18 and the unique activating mechanisms described more fully below while the other disc 14 is a base pad turret supporting the base pads as well as the vacuum manifold. During operation, the cans C are held in place by vacuum applied to the individual base pads. With the exception of drive motor, all mechanical components of the machine 10 are mounted on the two side frames 1002 and 1004 depicted in FIGS. 1A and 1B. Each frame 1002 and 1004 consists of a single piece of cast aluminum tooling plate, preferably 3.5 inches thick. The side frames 1002,1004 are bolted directly to the top surface of a machine base 1006 and may be secured thereto with steel braces (not shown). The machine base is preferably a one-piece steel weldment resting on five legs 1008, each equipped with a leveling screw. The main (necking) turret N and flanging turret 44 rest in yokes (not shown in detail) cut out of the top surfaces of the side frames 1002,1004. They are held in place by caps 1010 bolted to the side frames. The shafts for the star wheels 24, 42 and 50 and drive gears (not shown in FIGS. 1A or 1B but discussed in detail below) are mounted in holes bored directly through the side frames.

In order for the spin flow necking process to work, the can and the tooling must spin rapidly. As will be discussed more fully below, a drive gear mounted on the base pad side, drives 15 idler gears installed in the base pad turret 14. The idler gears each drive two individual base pad spindle gears, and transmit power to idler gears on the tooling disc turret 12 by means of shafts running between the two turrets 12,14. As on the base pad side, each of the 15 idler gears on the tooling disc turret 12 drives two spin flow tooling spindle gears. The common drive shaft assures that the tooling and the can, held in place by the base pad vacuum, both spin at the same rate. The rate of drive gear rotation varies with the operating speed of the main drive discussed infra.

More specifically, the tooling disc turret 12 and a parallel base pad turret 14 are mounted to main turret shaft 16 for co-rotation about a horizontal axis of rotation R as depicted in FIGS. 1A, 1B and 3. The plural spin flow necking assemblies 18 (FIG. 5), e.g., thirty identical assemblies to define a thirty station machine, are circumferentially mounted in equispaced relationship in pockets formed on the periphery of the tooling disc turret 12 in respective coaxial alignment with a corresponding number of base pad assemblies 20 (FIG. 20) for co-rotation about the turret axes R.

In operation, with reference now to FIGS. 1A–C and 2, can bodies C are sequentially fed in a known manner via supply chute 22 and infeed star wheel 24 to the necking region 26 between the two turrets 12,14. Each can C is loosely held in a peripheral semi-circular pocket 28 of the rotating infeed wheel with a stationary guide rail (not shown). As the can C is rotated by the wheel 24 into alignment with a spin flow necking assembly 18 and an associated base pad assembly 20 at the infeed location, it is deposited on a can support 30 (FIGS. 20 and 23) mounted to the inner vertical face 14*a* of base pad turret 14 for rough alignment with these spindle assemblies. A novel double acting base pad 32 (FIG. 20 and point A in FIGS. 1 and 2 timing diagrams) advances into contact with the bottom wall 34 of the can body C. The base pad assembly 32 applies a holding vacuum to the can bottom 34 by means of a unique vacuum distribution manifold described, infra, which lifts the can C from the can support 30 (point B in FIG. 1C) and advances it towards the associated spin flow necking assembly 18. The can open end 36 engages a holding or slide roll 38 (point D in FIGS. 1C and 2, and FIG. 5) of the necking assembly 18 so that the can is now fully supported and centered on the assemblies. Spin flow necking of the can side wall 39 defining open end 36 now occurs in the manner described more fully below with an outer forming roll 40 as the can C spins at high speed on the associated necking and base pad assemblies 18,20 during rotation about turret axis R (points E and F in FIGS. 1C and 2). After necking, and at predetermined angular intervals, the forming roll 40 and base pad 32 retract (points G-K in FIGS. 1C and 2) and the necked can is discharged from between the tooling disc and base pad turrets 12,14 (point L) onto transfer wheel 42 for delivery to flanging station 44 (FIG. 1 only) where flanging may occur in a known manner. The necked and flanged cans are then transferred from the flanging wheel 44 to exit chute 48 via a discharge wheel 50.

As will be seen below, the spin flow necking apparatus 10 of this invention is provided with numerous unique mechanisms and assemblies which enable reliable, high speed necking operations to occur as a result of the ability to exercise positive control over the can at all times.

Spin Flow Tooling Assemblies

Each necking spindle assembly 18, with reference to FIGS. 5 and 15,16, comprises a stationary spindle shaft housing 60 secured to a semi-circular pocket 62 or recess formed within the periphery of the tooling disc turret 12 via a clamping plate 64 and bolt assembly 66. Housing 60 is properly axially located within pocket 62 with shoulders 68 formed at opposite ends thereof which engage the inner and outer (rear) vertical faces 12*a* and 12*b* of the turret 12, respectively, as best depicted in FIG. 16. Each housing 60 supports, through pairs of roller bearings 70, a spindle shaft 72 which is rotatable about its axis of rotation R1 (parallel to turret rotational axis R) by means of a spindle gear 74 mounted to the shaft 72 between the front and rear bearings. As schematically depicted in FIG. 15 and as will be seen more fully below, each spindle gear 74 is rotated through a line shaft 76 and line shaft gear 78 thereon, and idler gearing arrangement 80 which transmits drive through the line shaft from a drive mechanism 82 (FIG. 3) mounted on the base pad turret side of the machine 10.

The holding roll or sleeve 38 is mounted to the front end of the necking spindle shaft 72 through a slide mechanism 84, keyed to the shaft at 86, which permits co-rotation of the roll while allowing it to be slid by the necking forces described more fully below in the axially rearward direction A away from an eccentric free wheeling roll 88 located adjacent the front face 38 of the holding roll. This axially fixed idler roll 88, having an axis of rotation R2 which is parallel to and rotatable about spindle axis R1 (from the eccentric solid line position depicted in FIG. 5 in supporting contact with the can open end into a radially inward clearance position (point G in FIG. 2) for removal of the necked can), is mounted via bearings 90 and a spacer 92 to an eccentrically formed front end 94 of an eccentric roll support shaft 96. This shaft 96 extends through a hollow support shaft 98 which in turn extends within the necking spindle shaft 72. The shaft 98 is supported in shaft 72 via bearings 100 which permit the spindle shaft 72 to be rotated by the spindle gear 74 without rotating the eccentric roll support shaft 96 mounted within shaft 98 with spacers 102. This support shaft 96 extends rearwardly from the necking spindle housing 60, through an end cap 104 bolted to the rear surface thereof as at 106, to project from the rear face 126 of the tooling disc turret 12 to locate a pinion 108 in coplanar alignment with a unique tooling activating assembly discussed, infra. The pinion 108 is secured for co-rotation to the rear end of the eccentric roll support shaft 96 with a fastening nut 110 threadedly secured to the threaded rear end of the shaft.

The outer forming roll 40 is mounted to the tooling disc turret 12 so as to be radially outwardly adjacent the holding and eccentric rolls 38,88 as depicted in phantom line in FIG. 5. The assembly for mounting the forming roll 40 and its relationship to the associated necking spindle assembly 18 and the can being necked is best depicted in FIGS. 15, 17 and 18 to be described below.

The can holding roll 38 is shaped with a chamfered leading edge 38*b* designed to first engage the open end 36 of a can C to support same for rotation about the spindle axis R1 under the driving action of the necking spindle gear 76 which is driven by the same drive mechanism 82 (FIG. 3) driving each base pad assembly 32 engaging the can bottom wall 34. The holder 38 is also free to slide axially but is resiliently biased into the can open end 36 via springs 112 which may be of the compression type.

In operation, the can open end 36 engages and is rotated by the holding roll 38. Each spin flow tooling activating assembly, described in detail below, sequentially rotates its associated eccentric roller 88 into engagement with a part of the inside surface of the can side wall 39 located inwardly adjacent the open end 36. The activating assembly then rotates the external forming roll 40 radially inward to begin to define a conical necked end on the can. The manner in which the holding roll 38, eccentric roll 88, and forming roll 40 operatively coact to neck in the open end 36 is disclosed in detail in U.S. Pat. No. 4,781,047 to Bressan et al, which issued Nov. 1, 1988 to Ball Corporation, Muncie, Ind. The Bressan et al '047 patent is incorporated by reference herein. Briefly, however, the necking process is explained as follows. The side wall 39 of the spinning can body is initially a straight cylindrical section of generally uniform diameter and thickness which may extend from a pre-neck 39' previously formed in the can side wall such as by static die necking. As the external forming roll 40 engages the can side wall 39, it commences to penetrate the gap between the fixed internal eccentric roll 88 and the axially movable support or holder roll 38, forming a truncated cone as depicted in FIG. 4A of the incorporated Bressan et al '047 patent. The side wall of the cone increases in length as does the height of the cone as the external forming roll chamfer continues to squeeze or press the can metal along the complemental slope or truncated cone 24*e* of the eccentric roll or sleeve 88 as depicted in FIG. 4B of the Bressan et al '047 patent. The cone continues to be generated as the external forming roll 40 advances radially inwardly (the holder 38 continues to retract axially) until a reduced diameter is achieved as depicted in FIGS. 4C and 4D of the Bressan et al '047 patent. As the cone is being formed, the necked portion or throat of the can C conforms to the shape of the forming portion of the forming roll 40. The rim portions of the neck which extend radially outwardly from the necked portion are being formed by the complemental tapers 40*a* and 40*b* of the forming roll 40 and holder roll 38 to complete the necked portion.

Although the spin flow necking process described hereinabove and in the Bressan et al '047 patent is relevant to the present invention, the spin flow necking achieved with this invention is not limited to the included angles disclosed in the Bressan et al '047 patent. Likewise, while the discussion of the necked geometry in the Bressan et al '047 patent and how it results in beam compression forces when a load is applied to the can are relevant, spin flow necking as achieved in the present invention is not necessarily so limited. Furthermore, the spin flow necking process described hereinabove may be modified by mounting a cam ring radially outwardly adjacent the holder or slide roll 38 so that the form roll 40 does not make initial or final direct contact with the slide roll but instead axially rearwardly displaces it through camming contact with the cam ring. By avoiding initial contact with slide roll 38, undesirable grooving of the can metal is avoided. Avoiding final contact with the slide roll 38 prevents excessive thinning of the flange-like peripheral edge of the open end. Details of the cam ring and its mounting arrangement and function within necking spindle assembly 18 are disclosed in U.S. patent application Ser. No. 07/929,933, entitled "Spin Flow Necking Cam Ring", to Harry Lee Jr. and H. Alan Myrick, being filed concurrently herewith and commonly assigned to Reynolds Metals Company, the disclosure of which is incorporated by reference herein in its entirety.

Outer Form Rolls and Mounting Assemblies

The outer form roll assemblies 120 are best depicted in FIGS. 15, 17 and 18. With reference to FIG. 17, each roll 40 is pivotally mounted to a the form roll pivot shaft 122 which extends within a cylindrical throughbore 124 formed in the tooling disc turret 12 to project outwardly from the turret rear face 12*b*. The pivot shaft 22 has opposite ends of reduced diameter 128*a*,128*b*. The rear reduced diameter end 128*a* is supported on rear main bearing supports 126 mounted adjacent rear face 12*b*. The forward reduced diameter end 128*b* extends forwardly from the inner vertical face 12*a* of the tooling disc turret 12 within a throughbore 130 formed within a cylindrical pivot shaft support 132 having a mounting flange 134 bolted to the turret inner face as at 136. The forward end 128*b* of the form roll pivot shaft 122 is supported within front main bearing supports 138 disposed in a stepped portion 140 of the support 132. A washer seal 142 is disposed in a stepped portion 143 of the throughbore 124 formed in the turret 12 at the interface between the turret rear face 12*b* and gear cover plate 144, and at the interface between the mounting flange 136 of the pivot shaft support 132 with inner face 12*a* to prevent lubrication grease from leaking at these interfaces.

A form roll mounting yoke 150 is mounted to the forward end 128*b* of the pivot shaft 122 to support the form roll 40 for rotation with the pivot shaft and in operative alignment with the holder 38 and eccentric roll 88 as best depicted in FIG. 17. The form roll mounting yoke 150 includes a clamp 152 of split ring configuration which is mounted to the pivot shaft forward end 128*b* and clamped thereto with a pair of clamping screws 154 drawing the split ring portions 150*a* and 150*b* together in clamping engagement. The form roll mounting yoke 150 is maintained in precise axial position on the pivot shaft 122 by means of a spacer element 156 located between the front end pivot shaft support bearing 138 and the rear surfaces of the clamping sections 150*a*,150*b*. A mounting cap 158 passes against the front surfaces of the clamping sections 150*a*,150*b* and is firmly secured thereto with a mounting bolt 160 extending axially into the end 128*b* of the pivot shaft.

A pair of mounting arms 162 and 164 extend radially inward from the clamp 152 section of the form roll mounting yoke 150 to locate the form roll 40 therebetween. With reference to FIG. 17, the form roll 40 is mounted on a support pin 166 having opposite ends rotatably journaled in the mounting arms 162,164. The form roll may be rotatably mounted to a cylindrical portion of a mounting hub 168 with a roller bearing 170. Hub 168 is mounted to pin 166. One end of the hub 168 is formed with a cylindrical recess 172 slidably interfitting with a spring mounting portion 174 fixed to the inner end of the pin 166 to capture a compression spring 176 therebetween. In this manner, as the pivot shaft 122 is rotated by the form roll activating plate in the manner described in detail below, the form roll 40 is pivoted by the mounting yoke 150 into radially inward contact with the can side wall 39 to neck in the open end 36 thereof while sliding against the bias of spring 176 along the chamfer 24*e* of the eccentric roll 88 to axially rearwardly displace the holder roll 38. As the form roll 40 is pivoted out of contact with the can C after necking, the form roll spring 176 biases the form roll back to its proper position depicted in solid line in FIG. 17.

The outer arm 164 (i.e., located closest to the base pad turret 14) is removably attached to the form roll mounting yoke 150 with a pair of bolts 180 to facilitate easy access to the form roll 40 for replacement or repair. As best depicted in FIGS. 15 and 18, this removable arm 164 is formed with an arcuate groove 182 adapted to receive a correspondingly arcuately shaped end 184 of the mounting yoke 150 to advantageously enable easy centering of the arms 162,164 and thereby the form roll 40 by ensuring that the form roll support pin 166 is parallel to the necking spindle axis R1.

The form roll mounting pin 166 preferably includes a tapped bore extending longitudinally therethrough from the outer end of the pin. The bore is filled with a thin grease which is adapted to saturate a wick 188 (FIG. 17 only) formed in a radial throughbore intersecting the lubricating bore. In this manner, a controlled amount of lubricating grease is provided between the form roll mounting hub 168 and pin 166 to permit smooth axial sliding movement of the form roll during necking.

Spin Flow Tooling Activating Assemblies

FIGS. 5–14 are illustrations of spin flow tooling activating assemblies, generally designated with reference numeral 200, corresponding to the number of necking spindle assemblies 18 mounted on the periphery of the tooling disc turret 12. With particular reference to FIGS. 6 and 7, each activating assembly 200 includes a cam follower section 202 having a cam follower 204 mounted to the rear face 12*b* of turret tool (FIG. 13) for co-rotation therewith while in rolling contact with a stationary cam 206 extending parallel to the rear face of the tooling disc turret. The cam follower section 202 is radially inwardly and outwardly displaced by cam 206, relative to rotational axis R, to transmit corresponding movement through a connecting rod mechanism 210 (FIG. 7) to a unique two-part tool activating plate assembly connected to the radially outer end of the connecting mechanism 210. Each plate assembly is rotatably mounted to the vertical rear or outer face 12*b* of the tooling disc turret 12 adjacent an associated spin flow necking assembly 18. A first or form roll pivot shaft of the activating plate 212 which is connected directly to the connecting rod mechanism 210, begins to rotate counterclockwise in FIG. 7 as the connecting rod is radially outwardly cammed. Since the activating plate 210 is mounted to the pivot shaft 122, at its rear portion 128*a*, of an associated form roll assembly 40 (FIGS. 8 and 17), this rotational movement (induced by rotation of turret 12) begins to rotate the form roll towards the holding and eccentric rolls 38,88 of the associated spin flow necking assembly 18 described above, in accordance with the timing diagrams of FIGS. 1 and 2 (e.g., point C).

This movement of the first activating plate 212 causes corresponding movement of a second or eccentric roll activating plate 214 through a spring mechanism 216. A toothed rack 218 mounted on plate 214 with bolts 220 is in meshing engagement with the pinion 108 mounted to the rear end of the eccentric roll support shaft 96 as aforesaid. Thus, as the outer form roll 40 is radially inwardly displaced towards necking contact with the can C, the eccentric roll 88 is rotated by the pinion 108 into operational supporting contact (FIGS. 1 and 2, point E) with the inner surface of the can side wall 39 for necking. Further rotation of the pinion the activating plate 214 is prevented via contact between a stop portion 222 formed on the plate 214 with a stationary stop 224 bolted to the tooling disc turret. Further radially outward movement of the cam follower 204 causes the form roll activating plate 212 to be further rotated in the counterclockwise direction with the spring 214 mechanism permitting a rotational separation between the plates 212,214 to occur. As the cam follower 204 travels to its radially outermost position depicted in phantom line (middle illustration) in FIG. 7, the pivot shaft 122 rotates the form roll 40 into complete necking contact (FIGS. 1 and 2, points E and F) with the can side wall 39 as aforesaid. As the cam follower 204 is then radially inwardly displaced during further rotation of tooling disc turret 12 about rotational axis R, the activating plate mechanism 200 rotates clockwise to initially rotate the form roll 40 out of contact with the necked can. As the form roll activating plate 212 rotates back into contact with the eccentric roll activating plate 214, further clockwise rotation causes the rack 220 to rotate the pinion 108 and thereby the eccentric roll 88 back to its center position for removal of the necked can as described below.

The tooling activating assembly 200 will now be described in detail with reference to FIGS. 7–14.

With reference to FIGS. 7 and 13, each cam follower section 202 includes the cam follower 204 rotatably supported on turret 12 through cam follower support bracket 225 having a radially inner end (relative to axis R) formed with an axially extending portion 227 inserted into a cylindrical bore 229 formed in the rear face 12*b* of the tooling disc turret 12. The axially extending portion 227 is rotatably supported in the mounting bore 229 with sleeve bearings 231. A mounting bolt 233 and washer 235 extends through portion 227 for rotatably retaining the mounting bracket 225 to the turret plate 12. The cam follower 204 is rotatably secured to the radial outer end 237 of the mounting bracket 225 with a mounting shaft and bolt arrangement 239 also depicted in FIG. 13 and is maintained in coplanar alignment with the stationary cam 206 by means of an offset portion 241 connecting the axially extending mounting portion 227 to the radial outer end 237 of the mounting bracket 225. The respective axes of rotation 245,247 of both the cam follower 204 and the axially extending mounting bracket portion 227 are parallel to the turret axis of rotation R to enable controlled radial inner and outer movement of the cam follower 204 along the stationary cam 206.

The cam follower 204 is bolted to a cam follower mounting bracket 250 in the form of a triangular connecting plate 252, at a lower end thereof, as best depicted in FIG. 7. The connecting rod section 210 has a lower end 254 rotatably secured to an upper end of the connecting plate 252. With reference to FIG. 6, the lower end 256 of an air spring 258 is also rotatably mounted to the upper end of the cam follower connecting plate 252 and the upper end 260 of the air spring is rotatably bolted via a mounting bracket 262 to the rear vertical face 12*b* of the tooling disc turret 12. The radially inwardly extending end 256 of the air spring 258 is threadedly secured to the cam follower connecting plate 252 to transmit air pressure force and thereby maintain the cam follower 204 in firm positive contact with the stationary cam during turret rotation.

The connecting rod section 210 includes a threaded fitting 254 rotatably secured to the upper end of the cam follower connecting plate 252, as aforesaid. A threaded screw 265 extends radially outward from threaded connection with this fitting 254. A lower spring rest 267 (FIG. 7) is secured to an intermediate portion of the threaded screw 265. With reference to FIGS. 9 and 10, the upper end of the connecting screw 265 and screw head 266 thereof is slidably received in an upper connecting portion 269 rotatably pinned to the outer form roll activating plate 212. More specifically, this upper connecting portion 269 has an upper end defined by a pair of parallel arms 271 secured with a pin 273 to an attachment ear 275 extending radially outwardly from the form roll activating plate 212. The lower end of the upper connecting member 269 is formed with a cylindrical collar 277 through which the uppermost portion of the screw 265 extends. The screw head 266 is captivated against the cylindrical collar 277 and is movable (in lost motion) along its longitudinal axis between the collar and the activating plate 212 in the unique manner described below.

A heavy spring 279 extends between the screw head collar 277 of the upper connecting member 269 and the lower spring rest 267 as best depicted in FIGS. 7 and 9. Under normal operating conditions, the spring 279 is sufficiently stiff to bias the screw head 266 firmly against the collar 277 to transmit camming movement from the cam follower 204 directly through the connecting screw 265 to the form roll activating plate 212 through the upper connecting member 269 in the manner described above. However, upon latching of the form roll activating plate 212 to prevent tool-to-tool contact between the form roll with the holding and eccentric rolls 38,88 in the unique manner described below, the foregoing connecting rod arrangement functions to allow the screw head 266 to lift upwardly from the collar 277 in a lost motion arrangement between the upper and lower connecting members 254,269 as the spring 279 is compressed as a result of the radial outward movement of the lower connecting member 254,265 induced by the cam follower 204.

With reference to FIG. 8, the form roll activating plate 212 includes a hub 300 mounted to the outermost or rear end 128*b* of the form roll pivot shaft 122 with a mounting cap 302 engaging the hub end face and a pair of mounting bolts 304 extending through the mounting cap into the rear end of the shaft. The form roll activating plate 212 is thereby co-rotatable with the form roll pivot shaft 122. The eccentric roll activating plate 214 is rotatably mounted between the rear face 126 of the tooling disc turret 12 and the form roll activating plate 212 on an intermediate portion of the pivot shaft via a cylindrical mounting support 306 disposed between the shaft and eccentric roll activating plate. More specifically, the mounting support 306 includes a mounting flange 308 bolted at 310 to a gear cover plate 312 through which the pivot shaft 122 extends. The plate 312 includes a stepped portion for locating the pivot shaft rear support bearing 126 between the mounting support 306 and the pivot shaft. A second bearing 126a spaced from the first bearing 126 with a spacer 314 is located at the rear end of the mounting support 306 to ensure that the support has idler motion.

The eccentric roll activating plate 214 is concentrically mounted to the support 306 with a further pair of bearings 316 and extends between the mounting flange 308 and hub portion 300 of the form roll activating plate 212. The rack 218 is bolted to a radially outwardly extending attachment portion 318 of the plate 214. Through these bearing arrangements 316, the eccentric roll activating plate 214 is capable of rotating freely relative to the form roll activating plate 212 and the pivot shaft 128b extending therethrough. Formed adjacent the rack 218 on the eccentric roll activating plate 214 is a spring mounting portion 320 having a spring mounting post 322 receiving one end of the spring 216 connecting the activating plates 212,214 together. The opposite end of the spring 216 (FIGS. 7 and 11) is connected to a spring post 324 secured to a radially outwardly extending spring mounting projection 326 formed on the form roll activating plate 212. Radial surfaces 320a,326a of these spring mounting portions 320,326, respectively, normally abut each other under the compression force of the connecting spring during initial rotational movement of both activating plates 212,214 under the camming action of the connecting rod arrangement 210, as foresaid. The spring 216 is sufficiently stiff to transmit rotational movement of the form roll activating plate 212 (acted upon by the connecting rod arrangement) until the radial stop 222 on the eccentric roll activating plate 214 contacts the stationary stop 224. At this point, the rack 218 has rotated the eccentric roll 88, through the pinion 108, to its eccentric most operating position (point E in FIGS. 1 and 2). Thereafter, the connecting spring 216 stretches as the form roll activating plate 212 continues to be rotated by the cam follower 204 through the connecting rod arrangement 210 to rotate the form roll pivot shaft 122 through its final rotational movement of an additional 3°–4° which moves the form roll 40 into complete necking contact with the can side wall, or into tool-to-tool contact with rolls 38,88. In the absence of this final rotational movement, complete necking or tool-to-tool contact will not occur.

During normal machine operation, there will be periods of time during which can bodies are not being supplied to the spin flow necking assemblies 18, such as during a temporary disruption in the supply of cans, or during down time attributable to repair or part replacement work at other stations. During such periods, it may be desirable not to shut the machine down. However, it is highly desirable to prevent metal-to-metal contact between the outer form roll 40 with the surfaces of the holding and eccentric rolls 38,88 which, in the absence of a can side wall 39 to be necked, causes unnecessary wear of the carbide surfaces of these tools. Therefore, the present invention advantageously features a plurality of latching mechanisms respectively associated with each activating plate assembly 200 for preventing final rotational movement of the form roll activating plate 212 to prevent the form roll from traveling through its final 3°–4° of angular movement into contact with the holder and eccentric rolls 38,88.

As best depicted in FIGS. 6, 7, and 12, each latching mechanism comprises a latch arm 330 formed with a cylindrical mounting hub 332 rotatably secured to the gear cover 312 plate (bolted to the tooling disc turret 12) by means of a pivot pin 334 received in the hub portion (FIG. 12). The latch arm 330 projects radially from the mounting hub 332 and is pinned to the forward end of a plunger 336 extending radially outwardly from an air operated cylinder 338. Cylinder 338 is pivotally mounted at its opposite end with a bracket 340 to the rear face 12b of the tooling disc turret 12 with a pair of screws 342. A pin 344 extends between a pair of parallel attachment ears 346 to secure the cylinder to the bracket 340.

The latch arm 330 includes a circumferentially extending latch projection 350 movable from its unlatched solid line position such as depicted in FIGS. 6 and 7 to its latched position depicted in phantom line position in FIG. 6. Upon sensing the absence of can bodies in the can supply line in a manner known to one of ordinary skill in the art, a solenoid (not shown) is actuated to simultaneously admit pressurized air into each of the air cylinders 338 to extend the plungers 336 and thereby simultaneously pivot the latches 330 into the latching position. Depending upon the angular position of a particular activating assembly 200 relative to the rotational axis R of the tooling disc turret 12, the generally radially extending latch surface 352 formed on the form roll activating plate 212 (see, e.g., FIG. 7) will either be upstream (solid line position) from the latch point L (indicating that the form roll 40 has not yet rotated into final necking contact) or downstream (phantom line - middle illustration) from the latch point (indicating that the form roll has rotated into complete necking contact with the can side wall 39).

In the event that the latching surface 352 of the activating plate 212 has not yet rotated to the latch point L, it will be appreciated that as the associated activation assembly 200 reaches an appropriate angular interval (i.e., between points E and F in FIGS. 1 and 2) in its rotation about the cam 206, the latching action will prevent final pivoting movement of the form roll into wearing contact with the carbide surfaces of the holder and eccentric rolls 38,88, preventing the form roll activating plate 212 from attaining its final 3°–4° of rotation. Since the cam follower 204 continues to travel to a top dead center (TDC) position along the cam 206, it will be appreciated that the final movement of the upper connecting rod arrangement 269 is advantageously taken up by lifting of the screw head 266 from the collar 277 against the bias of the heavy spring 279 in a lost motion arrangement. Since the latching surface 350 on the latch arm 330 and the latching surface 352 of the activating plate 212 are slightly undercut relative to each other to present a negative angle, it will be appreciated that the surfaces remain latched to each other even after air pressure on the latching cylinder 338 is released, until the activating plate latching surface 352 is positively rotated clockwise by the cam follower 204 out of contact with the latch arm 330. The arm 330 may then spring back to the unlatched solid line position under the return action of the spring loaded plunger 336.

It will be appreciated that by simultaneously pivoting all the latches 330 into latching position in the manner described above, such simultaneous latch activation essentially results in a sequential latching process. That is, since various of the activating plate assemblies 200 will be controlling associated necking spindles in the final stages of necking, the associated latches will simply contact the circumferentially extending trailing surface 354 of the latching projection on the form roll activating plate 212 and ride against that surface until the latching projection rotates clockwise from the latch point L. At that time, the latch arm 330 is now free to pivot into its final latching position L to prevent the aforesaid final rotational movement of the form roll activating plate 212. Thereby, the latches 330 advantageously serve to sequentially lock out one station at a time as the stations successively travel out of final necking contact with the can side wall, i.e., in the return or clockwise direction of the form roll activating plate 212 past the latching point L, to prevent tool-to-tool contact.

It will be appreciated that the sequential latching operation described hereinabove serves to only prevent the final rotational movement of each form roll 40 into contact with the forming surfaces of the other rolls 38,88. Otherwise, the eccentric roll 88 still operates to move back and forth through 180° and the outer form roll 40 is still pivoted through its range of movement except the final 3°–4° in the manner described above. The automatic latching mechanism thereby allows for automatic sequential latching and unlatching at each station from a one-time actuation of the latching cylinders 338 and a one time release.

Spindle Gear Drives and Main Shaft Drive

As mentioned briefly above, the holder roll 38 in each necking spindle assembly 18 is rotated through its associated spindle gear 74 by means of idler gears 80 adjacent ones of which are commonly rotated with a line shaft gear 78 connected via a line shaft 76 to a corresponding line shaft gear 78' in the base pad turret 14. FIG. 6 depicts the relative positioning of the line shaft gear 78 and the idler gears 80 relative to the spindle gear 74 in the tooling disc turret side 12 of the apparatus 10. With reference to FIG. 3, each line shaft gear 78 is mounted within a cylindrical recess 360 formed in the inner vertical face **12*a* of the tooling disc turret 12. A screw 78*a* extends radially through a hub portion 78*b* of the line shaft gear 78 for connection to the line shaft 76. A cover plate 362 having a mounting flange 364 bolted to the inner face 12*a* of the turret 362 is formed with a center bearing 366 providing mounting support for the line shaft 76 within the recess 360. Grease passageways 368 are formed in the cover 362** for passage of lubrication to the gear teeth.

As best depicted in FIG. 14, the rear face of **12*b* the tooling disc turret 12 is formed with a plurality of recesses 370 respectively adjacent each peripheral pocket 372 into which pocket a necking spindle assembly 18 is mounted. An idler gear 80 is rotatably mounted to a mounting projection 372 extending upwardly from the bottom wall 374 of the recess 370 via a pair of bearings 376 and a spacer 378 for coplanar alignment with the associated line shaft gear 78 and spindle gear 74. This recess opening 370 is covered with a left or right-handed kidney shaped cover plate 312 depicted in FIG. 6. The form roll pivot shaft 128*b* and main bearing supports 126 therefor are supported on an associated one of the cover plates 312 as best depicted in FIG. 8**.

FIGS. 15, 16 and 18 depict the manner in which the spindle assemblies 18 are respectively clamped to the tooling disc turret periphery. With reference to FIG. 15, each spindle assembly 18 is mounted within an associated one of the peripheral semi-circular pockets 372 or saddles formed in the turret 12. The clamping plate 64 has arcuate opposite clamping edges **64*a* contacting the outer surface of adjacent spindle housings 60. The plate 64 is bolted to the turret disc 12 with the pair of screws 66 extending radially into the turret periphery adjacent a pair of spindle assemblies 18. Spring washer means 380 are disposed between the outer surface of the clamping plate 64 and the screw head 66*a* to impart a clamping force against the spindle assembly housings 60. A locating washer 382 formed with a step portion 384 engages the shoulder 68 formed on each adjacent necking spindle housing 60 while also engaging the inner face 12*b* of the tooling disc turret 12 to properly locate the spindle housings within the saddles 372**.

As mentioned above, the spindle gear 74 in each of a pair of adjacent necking assemblies 18 is respectively driven through one of two idler gears 80 commonly rotated by a line shaft gear 78 mounted in the tooling disc turret 12 through the inner vertical face **12*a* thereof (FIG. 3). In a thirty-station machine, therefore, there are fifteen line shaft gears 78. These line shaft gears 78 are rotated by line shafts 76 extending between the tooling disc and base pad turrets 12,14. The second line shaft gear 78' is mounted on the line shaft 76 within the base pad turret 14 in coaxial alignment with the corresponding line shaft gear 78 in the tooling disc turret 12. This mounting arrangement is best depicted in FIG. 3 wherein it can be seen that the line shaft 76 passes through a throughbore 400 formed in the inner vertical face 14*a* of the base pad turret 14 and is supported therein with a bearing 402. This throughbore 400 communicates with a cylindrical recess 404 formed in the outer face 14*b* of the base pad turret 14. The base pad line shaft gear 78' is mounted on the line shaft 76 and disposed within this mounting recess 404 in coplanar alignment and meshing contact with a pair of idler gears 406 as best depicted in FIG. 19. These idler gears 406 are mounted in the base pad turret 14 in a manner similar to the idler gears 80 mounted in the tooling disc turret 12 as discussed in detail above. An associated pair of idler gears 406 driven through a common line shaft gear 78' are in respective meshing contact with a spindle gear 410 mounted in each of a pair adjacent base pad assemblies 415 (see FIGS. 19 and 20**) to thereby rotate the base pad assemblies (engaging the can bottoms) at the same rotational speed as the necking spindle assemblies (engaging the can open end). Grease passageways are provided to supply lubricating grease to the gears as is well known.

Each line shaft 76 projects outwardly from the outer vertical face **14*b* of the base pad turret 14 through a cover 420 bolted at 422 to close the line shaft gear mounting recess 404, as best depicted in FIG. 3. The line shaft gear 78' is mounted within this recess 404 on a reduced diameter end of the line shaft 76 in abutting contact with a shoulder 424 formed with the larger diameter portion of the line shaft which properly positions the line shaft gear within the recess. A collar 426 mounted on the line shaft 76 between the gear 78' and the cover 420** assures proper axially fixed location of the line shaft gear on the line shaft.

A second line shaft gear 430 is mounted to the outwardly protruding end of the line shaft 76 via a mounting hub 432 bolted to the gear as at 434. This second line shaft gear 430 is axially fixed to the line shaft 76 with a spacer disposed on the line shaft between the inner face of mounting hub 432 and the outer surface of the mounting cover 422. A cap 436 of sufficient diameter to contact the rear surface of the mounting hub 432 is bolted to the outwardly protruding end of the line shaft 76 at 438 to secure the second gear for co-rotation with the shaft.

The respective line shaft assemblies 76 are driven through meshing contact between the secondary line shaft gears 430 with a large diameter bull gear 440 (drive mechanism 82). With reference to FIG. 19, this line shaft bull gear drive 440 is formed as a split gear having segments 442 connected together with splice plates 444 and secured with bolts 446 to the annular mounting flange 448 formed at one end of a rotating mounting spool 450. This mounting arrangement is also clearly depicted in FIGS. 3 and 4. The feature of forming the bull gear 440 in separate sections 442 advantageously allows for easy disassembly for replacement or repair.

The main turret shaft assembly 16 to which the tooling disc and base pad turrets 12,14 are bolted at 458 via mounting flanges 460 integrally formed with the cast turret shaft is best depicted in FIGS. 3 and 4. In FIG. 3, the coaxially aligned and parallel spaced mounting relationship between the two turrets 12,14 is best depicted. The structure of the main turret shaft 16 extending rearwardly from the base pad turret (to the right in FIG. 3) is depicted in FIG. 4. Therein, a mounting hub 462 is keyed at 464 to the right hand end of the main turret shaft 16. A second bull gear 466 is mounted on the hub 462 to be driven with a motor means M and thereby rotate the main turret shaft about its axis of rotation R together with the tooling disc and base pad turrets 12,14.

The opposite end of the main turret shaft projecting from the rear face **12*b* of the tooling disc turret 12** is appropriately supported for rotation through support bearings which are not shown in detail for the sake of brevity but which will be obvious to one of ordinary skill in the art upon review of this specification.

Referring again to FIG. 4, the mounting spool 450 is essentially a hollow shaft which is generally co-extensive with that portion of the main turret shaft 16 projecting rearwardly from the base pad turret 14 and is rotatably concentrically supported on the shaft 16 through a pair of main mounting bearings 470 and 472 respectively mounted at opposite ends thereof. Stepped portions 474,476 and 478 are suitably provided between the inner surface 480 of the mounting spool 450 and the outer surface of the main turret shaft 16 to respectively locate seals 482, 484 and 486 on opposite sides of each main bearing 470,472 to maintain lubricating grease in the bearing areas. Mounting flanges 488 and 529 formed with O-ring seals in contact with the main turret shaft surfaces are bolted to the mounting spool 450 at opposite ends thereof to seal the bearing areas.

The mounting spool 450 is rotatable about rotational axis R. The mounting spool 450 and thereby the main turret shaft 16 are supported through bearings 490 (one also on the tooling disc side) on a stationary casting 492 bolted to a machine side frame 494 as at 496. More specifically, the casting 492 includes a large diameter throughbore 495 through which the mounting spool 450 and the main turret shaft 16 extend. A pair of roller bearings 500 are disposed against a rear facing shoulder 502 formed in a forwardly extending portion of the casting 492, in abutting contact with a corresponding shoulder formed in the outer surface of the mounting spool 450, to provide further rotational support for the mounting spool in cooperation with rear main bearing 490. Grease passageways 504 in the casting supply lubricating grease to the bearings 500 in a known manner. These bearings 500 are spaced from the main rear bearing 490 between the stationary casting 492 and the mounting spool 450 with a spacer 510 abutting against a seal member 512 located rearwardly adjacent the bearings 500. The main rear bearing 490 between the mounting spool 450 and casting 492 is disposed in a rearwardly facing annular recess 514 formed in a main rear bearing support mounting member 516. The member 516 has a radially outwardly extending mounting flange 518 interfitting with and bolted to the rear face of the casting 492 as at 520.

A chain driven sprocket 525 is mounted to the rear end of the mounting spool 450 with a key 527. The sprocket 525 is retained on the spool 450 with a closure cap 529 having a mounting flange abutting both the rear surfaces of the spool end and the sprocket and bolted to the end as at 531. This cap 529 is in sealing contact with the main turret shaft 16. A further seal member 533 is bolted to the rear mounting member 516 containing the main rear bearing 490, to provide a rear seal between the bearing and sprocket.

The main turret shaft drive M rotates the tooling disc and base pad turrets 12,14 with the main turret shaft 16 at approximately 65–70 rpm and preferably 67–68 rpm. The line shaft bull gear 440 is counter-rotated through the mounting spool 450 and chain driven sprocket 525 at approximately 200–220 rpm. By suitably sizing the diameter of the line shaft bull gear 440 and the driven gears 78', the line shaft gears 78 and thereby the necking and base turret spindle gears 74,410 are rotated at about 2,000–2,400 rpm to achieve proper spin flow necking speeds.

Double Acting Base Pad Spindle Assemblies

FIG. 20 is a representative illustration of one of the base pad spindle assemblies 415 (20) which are mounted in coaxial alignment with the necking spindle assemblies 18 within semi-cylindrical pockets 560 peripherally formed in equispaced relationship in the base pad turret 14. As best depicted in FIG. 19, the base pad spindle assemblies 415 are mounted in these pockets 560 with clamping plate and bolt/locating washer arrangements, generally designated with reference numeral 565, identical to the plate and washer arrangements 64,66 used to mount the necking spindle assemblies 18 to the tooling disc turret 12 in the manner described in detail above.

Each base pad spindle assembly 415 comprises a spindle shaft housing 570 having a large diameter throughbore 572 through which the base pad spindle assembly extends. More specifically, a base pad spindle 574 is rotatably supported within the housing 570 with a pair of support bearings 576 and 578 at opposite ends thereof. The base pad spindle gear 410 is keyed 580 to the spindle 574 rearwardly adjacent the front bearing 576 in coplanar meshing contact with one of the idler gears 406 mounted in the base pad turret 14 as described hereinabove. A cover plate 582 includes a mounting flange bolted at 584 to the front surface of the spindle housing 570 to retain the front bearing 576 and gear 410 in fixed axial position within the housing, in cooperation with a spacer seal 586 and lock washer 588 providing rear support for the front bearing and spindle gear to maintain same in desired axial location.

A hollow base pad support shaft 590 is secured for co-rotation with the spindle 574 with a key 592 extending radially inwardly from the spindle into an elongate slotted opening 594 in the support shaft which permits cam controlled sliding movement of the support shaft and base pad 32 mounted to the front end thereof. Base pad support shaft 590 is slidably supported at opposite ends thereof with frictionless support bearings 596 mounted in outwardly facing shoulders formed at opposite ends of the spindle throughbore 598. Lock washers and O-rings, generally designated by reference numeral 600, are used to maintain these frictionless bearings 596 within the axially fixed, rotating spindle 574. The front end of the base pad support shaft has a reduced diameter opening 602 receiving the front end of a vacuum tube 604 in interfitting relationship. This tube 604 extends through the base pad support shaft 590 and interfits, at a rear end 606 thereof, with one end of a throughbore 608 extending in a mounting plug 610 received in the rear end of the base pad support shaft to extend rearwardly therefrom. The rearwardly extending mounting plug 610 supports a rotary upon 612 through a pair of bearings 614 secured to the plug with a threaded lock washer 616. This rotary union 612 is connected to one of plural connecting rod assemblies depicted in FIGS. 21 and 24 which are reciprocated through a cam follower arrangement, described in detail below, to transmit corresponding reciprocating movement to the base pads 32 through the support shafts 590 through a predetermined stroke, in accordance with the timing diagram of FIGS. 1 and 2.

Extension of the base pad 32 which will be discussed more fully below, essentially allows the pad to make vacuum contact with the can bottom 34 (point B in timing diagram) and urge the container open end forwardly into contact with the holder roll 38 on the associated necking spindle assembly 18. Retraction of the base pad 32 to the solid line position in FIG. 20, after necking, disengages the base pad from the necked can to enable transfer of the can to a subsequent station as discussed above. An annular spring mount 620 engaging the rotary union 612 through interfitting mounting flanges 622,624, respectively, receives the rear end of a compression spring 626 having a forward end abutting against a rear facing shoulder 628 formed at the rear end of the spindle housing 570. This compression spring 626 normally biases the base pad 32 into its solid line retracted position. Vacuum is supplied to the base pad 32 through a unique vacuum manifold arrangement depicted in FIGS. 24–28 as will be described in detail below.

The base pad 32 has two relatively movable components in the form of an outer ring 630 having a front annular surface 632 adapted to contact the resting radius **34*a* of the can bottom wall 34 and a plug 634 disposed within a cylindrical recess 636 in the front surface of the outer ring. Plug 634 is adapted to initially extend forwardly from the outer ring annular surface 632 (see phantom line position) to engage, with an O-ring seal 638, an annular wall portion 34*b* of the can bottom wall 34 formed inwardly adjacent the resting radius 34*a*. Vacuum supplied through the plug 634 and base pad support shaft 590 can therefore apply suction to hold the can bottom wall 34 firmly against the outer ring 630** and plug as depicted in phantom line.

More specifically, the bottom wall of the cylindrical plug mounting recess 636 is formed with a throughbore receiving a rearwardly axially extending, cylindrical mounting portion 640 of the plug 634. The rear face of this rearwardly extending portion 640 has a cylindrical recess 642 into which a forwardly extending mounting hub portion 644 of the base pad support shaft 590 extends in interfitting engagement. Both the plug 634 and mounting hub 644 portion have coaxially aligned through passages interfitting with the vacuum tube 604 in the base pad support 590 shaft to transmit vacuum to the can bottom wall 34.

The plug 634 is movable with the base pad support shaft 590 to initially project forwardly from the outer ring front surface 632 by approximately 0.105 inches during initial forward extension of the base pad support shaft 590 until the front annular surface 648 thereof extending around the mounting hub portion 644 contacts the rear annular surface 650 of the outer ring 630. Thereafter, continued forward extension of the support shaft 590 urges the outer ring 630 forwardly with the plug 634 in the relative phantom line position shown. Aligned bores formed in a radially outer annular portion 651 of the plug 634, the bottom wall 652 of the outer ring 630, and the front end wall of the base pad support shaft 590 respectively receive a plurality of slide pins 655 (one shown) for maintaining the plug in precise coaxial alignment with the outer ring. A plurality of circumferentially spaced aligned bores (one set shown) formed in alignment with each other in alternately spaced locations in the outer ring bottom wall 652 and annular portion 651 of the plug 634 captivate compression springs 660 to ensure that the loosely mounted outer ring 630 is rearwardly biased into seating contact with the front surface 648 of the base pad support shaft 590 in the extended position.

FIGS. 21 and 22 are illustrations of connection rod assemblies, generally designated with reference numeral 700, which are cam controlled to reciprocate each base pad 32 in extension and retraction strokes as a function of the relative angular position of the base pad and its associated necking assembly about the rotational axis R, in accordance with the timing diagram of FIGS. 1 and 2. As will be seen more fully below, there is a connection rod assembly and associated cam follower 702 for each base pad spindle assembly 415. The connection rod assemblies 700 are mounted to a split cover 704 which extends loosely around the mounting spool 450 (FIG. 21) rearwardly adjacent and parallel to the line shaft bull gear 440. The split cover has a peripheral mounting flange **704*a* (FIG. 21 only) through which it is bolted to a mounting flange 14' extending axially and rearwardly from the base pad turret 14. The split cover also functions as a cam follower support plate for cams 702 and is co-rotatable with the base pad turret 14. The stationary cam 706 is mounted rearwardly adjacent the cover 704 to the front end of the stationary casting 492 with an annular mounting plate 708 bolted to the casting front end at 710. Plate 708 has a radially outwardly extending flange 712 to which a radially inwardly extending flange on the cam 706 interfits for attachment thereagainst with bolts 714**.

Each cam follower 702 is mounted within a mounting yoke 718 for rotational movement about a horizontal axis R3 (FIG. 22) parallel to rotational axis R. This mounting yoke 718 is schematically depicted in FIGS. 4, 21 and 22. As best depicted in FIG. 21, a connecting rod arrangement generally designated by reference number 720 extends horizontally forward from the cam follower 702 towards the split cover plate 704. A cam follower mounting plate 722 is bolted to the hub portion 724 of the split cover plate 704 with bolts 726 and is formed with a plurality of protrusions or humps 728 (best shown in FIG. 22) equispaced from each other around the periphery of the cam follower mounting plate 722. This mounting plate 722 is omitted from FIG. 4 for simplicity. The protrusions 728 correspond to the number of necking stations (i.e., 30 in the preferred embodiment). The cam follower connecting rod arrangement 720 is secured to an associated one of protrusions 728 with a bushing 730 into which is fitted a pivot pin 732.

The difference between the minimum and maximum cam radii in the preferred embodiment is 1.313 inches and movement of the cam follower 702 along the cam surface 706 is translated to the base pad spindle assembly 32 via movement of the rotary union 612 through 1.313 inches in the direction parallel to the base pad spindle axes R1. More specifically, the rising and falling movement of the cam follower 702 (which is a pivotal movement of mounting yoke 718 about R3) is transmitted to a linkage mechanism 735 having a lower end secured to a ball joint mechanism 737 in the mounting yoke arrangement 718 and an upper end pivotally secured to an upper connecting rod arrangement 740 through a similar ball joint mechanism 739. This upper connecting rod arrangement 740 extends towards the split cover plate 704 parallel to the lower connecting rod arrangement 720 and comprises a first connecting rod portion 742 interfitting and pivotally secured to a pair of bracket arms 744 projecting rearwardly from bolted attachment at 746 to the periphery of the split cover 704. The pivot is defined by a pivot pin 750 extending in a horizontal plane perpendicular to the rotational axis R as best depicted in FIG. 21. A mounting fork 752 integrally formed with the movable connecting rod arrangement (i.e., secured to the pivotal portion 742 of the upper connecting rod) projects radially outwardly for pinned engagement in a pair of elongated horizontal slots 755 extending transversely to the base pad spindle rotational axes R1 as best depicted in FIG. 21.

With the foregoing connecting rod assemblies, the rise and fall of each cam follower 702 translates into pivotal movement about pivot 732 relative to the split cover plate 704 and vertical movement of the linkage 735. This in turn rotates the pivotal connection between the linkage 735 and upper connecting arm 740 relative to the pivot 750 defined between the fixed and movable portions 742,744 of the upper connecting arrangement. In this manner, the distal end of the mounting fork 752 is correspondingly rotated about the pivot 750 causing reciprocation of the rotary union 612 and thereby the base pad 32 in accordance with the timing diagrams of FIGS. 1 and 2.

Vacuum Distribution for Locating and Holding Cans to Base Pads

As mentioned above, vacuum is supplied through each rotary union 612 to successively suck each can bottom wall 34 onto the base pad 32 of each of the thirty spindle assemblies 415 and to continuously supply suction to the bottom wall to maintain the can in proper position between the associated necking and base pad spindle assemblies 18,415. With numerous stations as in the present invention, a large volume supply of vacuum must be available to achieve reliable and continuous operation. In the event that there is a disruption in the supply of cans C to the machine 10, the last few cans in the supply (i.e., when there are fewer cans last to be necked than the number of stations) essentially cause there to be empty stations and thereby base pads which are sucking to atmosphere and wasting vacuum. Unless there is a sufficiently large and expensive vacuum pump, or blower supply of vacuum, which is capable of providing sufficient vacuum to all stations while compensating for one or more empty stations through which vacuum is lost, a vacuum system may be unable to retain the remaining cans to be necked to the base pad spindle assemblies.

In accordance with a unique feature of this invention, a novel vacuum manifold arrangement 800 is used to supply vacuum without resort to expensive vacuum systems.

With reference to FIGS. 4 and 24–28, the vacuum supply system 800 to the base pad spindle assemblies 415 features a stationary manifold 802 mounted to the stationary casting 492 through a manifold support plate 804 and a vacuum infeed supply plate 806. A plurality of vacuum supply hoses 808 are secured to the stationary casting 492 through fittings 810. Selected ones of these supply hoses identified by reference numeral 812 in FIG. 24 only are connected to a blower vacuum source B to supply low or soft vacuum (e.g., 5–7 inches Hg) at high flow volumes to those base pad assemblies 415 which have just received (point A in timing diagram) cans to be necked from the infeed transfer wheel 24. This high volume flow of low (soft) vacuum air is transmitted through outfeed vacuum lines 815 to the vacuum tube 604 formed in the base pad support shaft 590 and plug 634 to draw the can bottom wall 34 into sealing contact with the outwardly protruding plug as depicted in phantom line in FIG. 20. These outfeed vacuum lines 815 are in turn connected to a wear plate carrier 820 which is mounted for rotation on the stationary casting 492 through a pair of support bearings 822 best depicted in FIG. 4. Outfeed vacuum lines 815 selectively communicate with the blower slots 830 (connected to blower B) in the manifold 802 through a wear plate 840 which is secured for rotation with the wear plate carrier 820 with bolts 832.

Rotation wear plate 840, as best depicted in FIG. 25, is formed with a plurality of large diameter holes 845 circumferentially equispaced from each other for selective alignment with the non-rotatably fixed infeed vacuum slots 830 in the infeed location discussed above, and a plurality of small diameter holes having orifices 850 which are radially inwardly spaced from the large diameter holes 845 and connected thereto through passages 852 (FIG. 27) for selective alignment with the maintenance vacuum slots 860 (FIG. 24) subtending the major circumferential extent of the manifold plate 802. A source of high suction H (18 inches of mercury), such as is conventionally available in an operating plant system, transmits hard vacuum through infeed hoses 808 depicted in FIG. 24 which is in turn transmitted through the manifold 802 (through slots 860) and control orifices 850 to those base pad assemblies 815 upon which the cans to be necked have already been secured by high volume, low suction air to the base pads 32. A relatively low volume (compared to the "high volume") of high vacuum air is thereby used to maintain the can bottoms in firm seating contact with the base pads 32 during the necking process as the cans continue to be rotated with the turrets 12,14. After necking, as the base pads 32 are successively rotated towards the discharge transfer wheel 42 in FIG. 1, the vacuum in the base pad spindles 32 is broken via communication with atmosphere through a venting slot 870 formed in the manifold 802.

As mentioned above, the stationary manifold 802 is in the form of flat annular ring provided with a first set of vacuum slots 830 formed at circumferentially spaced intervals from each other along a common radius C1, and a second set of circumferential vacuum slots 860 extending along another common radius C2, wherein C1>C2. The first and second sets of slots 830,860 selectively communicate with infeed lines 808 or 812 through openings 890 in the manifold supply ring 802 which may be a split ring formed of segments 880 bolted to support plate 804 at 882 (FIG. 26). The first set of supply slots 830 subtend an angular interval of approximately 30°-50°, at angular positions (relative to rotational axis R) coinciding with the point at which the cans to be necked are fed onto the base pad turret 14 by the infeed transfer wheel 24 as discussed above. These slots 830 are best depicted in FIG. 24 and in FIG. 26 wherein it can be seen that the manifold is bolted to the manifold support ring 804 in an annular mounting channel 892 of rectangular cross-section which faces the wear plate 840. The support plate 804 includes cylindrical throughbores 894 at circumferentially spaced intervals along radius C2. The vacuum infeed supply ring 806 is bolted to the manifold support ring 804 with circumferentially spaced bolts 894 as depicted in FIG. 28. The manifold and support assembly, as best depicted in FIG. 28 is mounted to the stationary casting 492 with a plurality of circumferentially spaced bolts 900 having compression springs 902 extending between a spring mount 904 at one end of each bolt with the opposite spring end being respectively received in blind cylindrical bore 906 formed in the rear surface of the vacuum supply ring 806. Alternately spaced between these spring mounts are rearwardly projecting sleeves 910 in coaxial alignment with the manifold support ring supply bores 894 (see FIG. 4). The inner cylindrical throughbore of each sleeve 910 is in sliding sealing contact with a supply nipple 912 bolted to the stationary casting 492 in alignment with an L-shaped vacuum supply passage 914 connected to the appropriate one of vacuum supply lines 808 or 812 with a fitting 810.

The wear plate 840 is rotated relative to the vacuum manifold ring 802 in synchronism with the main turret shaft assembly 16 through a radially outwardly extending drive yoke 920 bolted at its radially inward end to the wear plate carrier 820 as best depicted in FIG. 4 and which is formed with a pair of bifurcated arms 922 at its radially outer end through which extends one end of a drive shaft 924 projecting rearwardly from the split cover plate 704 (FIG. 22) supporting the base pad connecting rod arrangements discussed, supra. The mounting of this vacuum distribution wear plate drive shaft 924 is best depicted in FIG. 22 wherein it can be seen that the drive shaft includes a mounting flange 926 at its forward end bolted to the rear vertical surface of the split cover plate 704 with bolts 928. Since this split cover plate 704 is bolted to the base pad turret 14 through the mounting flange as depicted in FIG. 21, the drive shaft 924 co-rotates with the base pad turret 14 and this timed movement is transmitted directly to the vacuum distributing wear plate 840 through the drive yoke 920.

In the wear plate, the number of pairs of adjacent large diameter vacuum ports 845 and radially inwardly spaced control orifices 850 correspond to the number of stations of necking and base spindle assemblies 18,32. Therefore, as one of the pairs of vacuum distribution openings 845,850 rotate into alignment with the first set 830 of slots in the manifold plate 802, the large diameter ports 845 align with the first slot while the radially inwardly adjacent orifice 850 is covered by the surface of the manifold plate 802. In this manner, a high volume flow of low vacuum air is supplied to the associated base pad assembly 32 through the vacuum lines 812,815 and wear plate carrier 820 to suck the can to be necked onto the base pad.

As the pair of distribution openings 845,850 (corresponding to a station) continue to co-rotate with the wear plate carrier 820 out of alignment with the first set of slots 830 in the manifold ring 802, the radially inwardly adjacent control orifice 850 rotates into alignment with the first of the second set 860 of circumferentially extending maintenance slots which is supplied with a hard (high) vacuum (e.g., 17-19 inches mercury) through a line 808 such as from a plant vacuum system. Since a vacuum of approximately 12-13 inches of mercury is desirable to maintain each can bottom 34 on its associated base pad spindle 32 for necking, and since the can has already been sucked onto the base pad assembly, only a small amount of hard vacuum is necessary to continue to maintain the can bottom in vacuum contact with the base pad. This is achieved through the control orifice 850. Communication between the control orifices and the second slots occurs throughout necking. Subsequently, as the necked cans travel to the discharge point, the control orifice enters into communication with a final slot 870 in the manifold ring 802 which communicates with atmospheric pressure to break the vacuum and allow the necked can to be released form the base pad assembly for discharge onto a transfer wheel.

The feature of having high and low vacuum delivery systems selectively supplied to the base pad spindle assemblies as a function of their rotational angular position relative to the turret axis avoids the need for large and expensive vacuum pumps and reservoir systems by allowing high volume, low (soft) vacuum to be supplied only at the initial infeed stages of mounting the unnecked can to the base pad, after which the base pad and the synchronously co-rotating wear plate rotate out of contact with the high volume vacuum supply for retention on the base pad during necking through communication with the low volume, high (hard) vacuum supply through the control orifice. As the system starts up, or as the supply of cans terminates, the feature of supplying vacuum to the majority of stations through the control orifices minimizes leakage and the pressure drop which occurs across the orifice if a can is missing. In this manner, during initial start-up, as the cans begin to be conveyed around the turret into communication with the retention slots 860, sufficient hard vacuum is supplied across the orifice notwithstanding the leakage occurring at the other empty stations through the small diameter orifices communicating with atmosphere. Further, since high volume, low vacuum suction is supplied only to one or two stations through the first set of slots, the high vacuum tends not to drop down so low that the first or last can does not get sucked up properly onto its associated base pad spindle.

The unique mounting and timed movement of the rotating wear plate relative to the stationary manifold ring in contact therewith allows for the sequential unloading and loading of the turrets with cans without requiring complex valving and electronic controls for distributing vacuum to the base pad assemblies as a function of their rotational position about the turret axis.

From the foregoing description, it can be seen that the machine 10 of this invention is possessed of numerous features which contribute to high speed reliable handling of the cans at high manufacturing speeds such as 1,500–2,000 cans per minute or higher. For example, the feature of utilizing different vacuum levels to initially mount the can bodies to the base pad assemblies and then maintain the cans on the base pads during necking advantageously ensures that sufficient vacuum is available in the absence of cans at some stations (at the onset or end of can supply) to ensure that all available cans are reliably necked with minimal waste. The vacuum manifold arrangement, as mentioned above, also ensures that suitable vacuum levels are appropriately supplied to the proper stations without resort to complicated valving or electronic control systems.

The feature of forming the base pad with a movable center section (plug) which is first advanced to protrude from the outer mounting ring section for engagement with the can bottom serves to ensure proper and reliable seating contact of the can on the base pad. This provides better centering of the can on the pad as well as the holding role 38.

The bull gear mounted on the base pad turret side of the machine provides rotative drive to the base pads and the necking spindles through the line shafts. This simplified single drive arrangement simplifies the machine.

The feature of a removable mounting arm in the mounting assembly for each other form roll advantageously allows for easy access and replacement of the form roll. By forming an arcuate locating groove between the removable mounting arm and mounting yoke, precise automatic centering of the form roll during reassembly is assured.

The use of a single cam for supplying the motion both for activating the eccentric roll and the outer form roll also serves to simplify the mechanisms within the machine.

Finally, the latching mechanisms essentially operate as a sequential latching arrangement in which the stations are sequentially locked one at a time, or unlocked, by the single actuation of an actuating member such as a solenoid. This simplified design minimizes the use of expensive sensing and control systems and prevents tool-to-tool contact in the absence of can supply.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. Spin flow forming apparatus for reducing the diameter of an open end of a cylindrical container body, comprising:

a tooling disc turret and a base pad turret mounted for co-rotation with a main turret shaft;

a plurality of necking spindle assemblies mounted on the tooling disc turret at circumferentially spaced intervals from each other;

each said necking spindle assembly including a first member engageable within the open end to support the container open end on the spindle and a second member mounted adjacent the first member for positioning within the container interior inwardly adjacent the first member;

a plurality of base pad spindle assemblies mounted on the base pad turret in respective coaxial alignment with said necking spindle assemblies, for respectively engaging a bottom wall of one said container body;

means mounted on the tooling disc turret externally of the container body for radially inward movement into necking contact with the container side wall, whereby relative movement of said externally mounted means in cc-action with said first and second members causes radial inward deformation of the container open end to neck-in said end; and locking means mounted on the tooling disc turret for limiting movement of said externally mounted necking means towards said first and second members under a predetermined supply condition of container bodies to said apparatus.

2. Apparatus of claim 1, wherein said locking means is responsive to a signal indicative of a disruption in the supply of container bodies to the apparatus to prevent tool-to-tool contact between the externally mounted necking means with said first and second members.

3. Apparatus of claim 1, further comprising means for moving said second member into contact with the side wall of the container body to be necked and out of contact with said necked-in side wall.

4. Apparatus of claim 3, wherein said moving means includes a gear means operatively connected to said second member and located outwardly adjacent a rear face of the tooling disc turret.

5. Apparatus of claim 4, further comprising means, operatively connected to said locking means, for moving said externally mounted necking means, wherein said necking moving means includes a shaft means projecting rearwardly outward from the tooling disc turret to define a pivot axis about which said externally mounted necking means pivots towards and away from the first and second members.

6. Apparatus of claim 5, further comprising a cam mounted adjacent the tooling disc turret; and connecting means, including a cam follower, for transmitting camming movement to both said shaft means and said gear means to selectively control the movement of said second member and said externally mounted necking means.

7. Apparatus of claim 6, wherein said connecting means includes a first activating plate mounted on the shaft means for co-rotation therewith, said first activating plate being directly connected to the cam follower through a connecting rod arrangement which rotates the first activating plate and thereby the shaft means through a first predetermined angular interval sufficient so that the externally mounted necking means contacts one of the first and second members or the container body side wall interposed therebetween.

8. Apparatus of claim 7, wherein said connecting means further includes a second activating plate mounted on said shaft means for co-rotation with and by the first activating plate through a means for connecting said first and second plates together, said second activating plate including means for rotating said gear means during co-rotation of said second activating plate.

9. Apparatus of claim 8, further including stop means for limiting movement of said second activating plate without preventing further rotational movement of the first activating plate through said first predetermined angular interval.

10. Apparatus of claim 9, wherein said stop means is a stop lug attached to said rear face of the tooling disc turret in alignment with and to contact a stop projection extending radially outward from the second activating plate.

11. Apparatus of claim 10, wherein said plate connecting means includes a spring means normally biasing the first and second activating plates together and which plate connecting means is resiliently yieldable to allow further rotation of the first activating plate against spring bias after the second activating plate is stopped with the stop means.

12. Apparatus of claim 8, wherein said locking means includes means for latching the first activating plate to prevent final rotational movement thereof through its entire first predetermined angular interval and thereby prevent tool-to-tool contact between the externally mounted necking means with said first and second members.

13. Apparatus of claim 12, wherein said latching means includes a latching projection formed on the first activating plate; a latch operatively mounted adjacent the first activating plate and means for moving the latch between a latch position whereby said latching projection rotates into latching contact with said latch to prevent said final rotational movement, and an unlatched position where the first activating plate is free to rotate through said final rotational movement.

14. Apparatus of claim 13, wherein the latching projection projects radially outward from the first activating plate and said latch is pivotally mounted to the tooling disc turret to project radially inward into the path of movement of said latching projection for latching to occur.

15. Apparatus of claim 1, wherein each said necking spindle assembly includes a spindle housing; a spindle shaft supported for rotation with the spindle housing; a spindle gear mounted to rotate the spindle shaft and thereby the first member co-rotatably mounted to said spindle shaft; means for resiliently biasing the first member towards the second member and being resiliently slidable against said bias, in the direction away from the second member, as the externally mounted necking means moves radially inward into contact with one of the first and second members or the container side wall interposed therebetween so as to displace the first member from the second member, said second member being a roll eccentrically mounted in relation to the spindle axis on a support shaft extending through the spindle shaft.

16. Apparatus of claim 15, further comprising a plurality of first line shaft gears mounted at spaced circumferential locations from each other in the tooling disc turret, and a plurality of pairs of idler gears mounted in the tooling disc turret with the idler gears in each pair in respective contact with one of the spindle gears; a plurality of second line shaft gears mounted at spaced circumferential locations from each other in the base pad turret in rotating contact, through other idler gears operatively mounted in the base pad turret, with a pair of spindle gears respectively mounted for rotating adjacent ones of the base pad assemblies; a plurality of line shafts extending between the turrets for respectively connecting associated ones of the necking and base pad spindle gears in coaxial alignment with each other; common gearing means, rotationally supported through bearings on the main turret shaft, for simultaneously rotating said line shafts through intermediate gears respectively mounted on said line shaft in meshing contact with said common gearing means.

17. In an apparatus for changing the shape of a plurality of metal products, said apparatus including at least one turret mounted for co-rotation with a main turret shaft; means for locating said plurality of metal products on said turret at spaced intervals from each other: first tool means and second tool means on said turret and relatively movable toward each other for contacting said metal products to change said shape, whereby the absence of a said metal product on said turret allows tool-to-tool contact and wearing of forming surfaces on said first and second tool means; the improvement comprising locking means responsive to a signal indicative of a disruption in the supply of metal products to the apparatus to prevent tool-to-tool contact between the first and second tool means by preventing the second tool means from completing its entire range of movement against said first tool means.

18. A method of spin flow necking an open end of a metal container body, comprising the steps of:

a) feeding a container body between a necking spindle assembly mounted on a first turret and a base pad spindle assembly mounted on a second turret in coaxial alignment with the necking spindle assembly while co-rotating said first and second turrets about their common axes of rotation;

b) locating a bottom wall of the metal container body in suction contact with the base pad spindle assembly;

c) locating the open end of the container body on the necking spindle assembly;

d) spinning the thusly centered container body by rotating the necking and base pad spindle assemblies about their common axes of rotation which is parallel to the turret rotational axes; and e) wherein, during step b), a centrally located plug on the base pad spindle is initially extended relative to a surrounding outer ring to project forward from said ring, and then said plug and ring are jointly moved forward until the plug through which suction is supplied in step b) engages the bottom wall of the container body in suction contact while the outer ring contacts the bottom wall at locations radially outwardly adjacent the plug in supporting engagement.

19. Spin flow forming apparatus for reducing the diameter of an open end of a cylindrical container body, comprising:

a tooling disc turret and a base pad turret mounted for co-rotation with a main turret shaft;

a plurality of necking spindle assemblies mounted on the tooling disc turret at circumferentially spaced intervals from each other;

each said necking spindle assembly including a first member engageable within the open end to support the container open end on the spindle and a second member mounted adjacent the first member for positioning within the container interior inwardly adjacent the first member;

a plurality of base pad spindle assemblies mounted on the base pad turret in respective coaxial alignment with said necking spindle assemblies, for respectively engaging a bottom wall of one said container body;

means mounted on the tooling disc turret externally of the container body for radially inward movement into necking contact with the container side wall, whereby relative movement of said externally mounted means in co-action with said first and second members causes radial inward deformation of the container open end to neck-in said end; and means for supplying suction to the base pad spindle assemblies, said suction supplying means including first means for supplying suction under a first predetermined condition to selected ones of the base pad spindle assemblies and second means for supplying suction under a second predetermined condition different from the first predetermined condition, to others of the base pad spindle assemblies.

20. The apparatus of claim 19, wherein said first means supplies a high volume flow of vacuum air under a first negative pressure level as said first predetermined condition to said selected ones of the base pad spindle assemblies adjacent which container bodies to be necked have just been fed to the base pad turret, said high volume flow of vacuum air being sufficient to suck the container bottom wall onto the associated base pad spindle.

21. The apparatus of claim 20, wherein said second means supplies a low volume flow of vacuum air, relative to said high volume flow, under a second negative pressure level as said second predetermined condition and which is different from the first negative pressure level, to said other base pad spindles located at rotational positions on the base pad turret downstream from those positions in communication with said first means, said low volume flow and second pressure level being sufficient to hold said container bodies to their base pads while necking-in forces are applied to the container open end.

22. The apparatus of claim 21, wherein said first negative pressure level is in the range of 5–7 inches mercury and said second pressure level is in the range of about 17–19 inches mercury.

23. The apparatus of claim 21, wherein said suction supplying means includes:

i) a wear plate and means for mounting said wear plate for co-rotation with the base pad turret, said wear plate including pairs of radially adjacent different diameter first and second ports formed at circumferentially spaced intervals on and wear plate;

ii) a vacuum distribution manifold and means for mounting said manifold stationarily adjacent and in sliding contact with one side of said wear plate, said manifold including at least one circumferentially extending first slot located at the same first radius as the first radius of the first port to communicate with an inlet side thereof, and at least one circumferentially extending second slot located at the same second radius as the second radius of the second port to communicate with an inlet side thereof and located downstream from the first slot;

iii) means for supplying suction to the first slot to achieve said first negative pressure level, and means for supplying other suction to the second slot to achieve said second negative pressure level; and iv) means, co-rotatable with the wear plate and adapted for communication with the outlet side of each first and port, for transmitting suction to said base pads;

wherein base pads in communication with the first slot through the first port(s) are subjected to the first negative pressure level and other base pads in communication with the second slot through the second ports are subjected to the second negative pressure level.

24. The apparatus of claim 21, further comprising locking means mounted on the tooling disc turret for limiting movement of said externally mounted necking means towards said first and second members under a predetermined supply condition of container bodies to said apparatus.

* * * * *